US011613449B2

(12) United States Patent
Koyahata

(10) Patent No.: US 11,613,449 B2
(45) Date of Patent: Mar. 28, 2023

(54) AUXILIARY SHEAVE DEVICE AND CRANE INCLUDING THE SAME

(71) Applicant: KOBELCO CONSTRUCTION MACHINERY CO., LTD., Hiroshima (JP)

(72) Inventor: Akira Koyahata, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 247 days.

(21) Appl. No.: 16/924,272

(22) Filed: Jul. 9, 2020

(65) Prior Publication Data

US 2021/0061624 A1 Mar. 4, 2021

(30) Foreign Application Priority Data

Aug. 29, 2019 (JP) ..... JP2019-157202

(51) Int. Cl.
*B66C 23/66* (2006.01)
*B66C 23/88* (2006.01)
(Continued)

(52) U.S. Cl.
CPC ..... *B66C 23/88* (2013.01); *B66C 13/06* (2013.01); *B66C 23/66* (2013.01); *B66D 3/08* (2013.01)

(58) Field of Classification Search
CPC ..... B66C 23/66; B66C 23/702; B66C 23/88; B66C 23/92
See application file for complete search history.

(56) References Cited

U.S. PATENT DOCUMENTS 3,037,641 A * 2/1962 Potter ..... B66C 23/34 212/295
3,955,684 A * 5/1976 Novotny ..... B66C 23/74 212/299

(Continued)

FOREIGN PATENT DOCUMENTS

EP 2 476 642 A1 7/2012
JP 2018-070310 A 5/2018

OTHER PUBLICATIONS

Extended European Search Report dated Jan. 12, 2021 in European Patent Application No. 20185111.0, 8 pages.

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

Provided is an auxiliary sheave device with a simple and lightweight structure and a crane including the same. The auxiliary sheave device, provided in the crane including a derrick member guy line, includes an auxiliary sheave frame and an auxiliary sheave guy line supporting the auxiliary sheave. The derrick member guy line is connected to the distal end portion of the derrick member. The auxiliary sheave frame is attached to the distal end portion of the derrick member so as to be capable of making rotational movement and taking a projecting posture of projecting in the distal end direction from the distal end portion of the derrick member. The auxiliary sheave guy line is connected to the distal end portion of the auxiliary sheave frame and a guy line connection portion of the derrick member so as to keep the auxiliary sheave frame in the projecting posture.

15 Claims, 26 Drawing Sheets

(51) Int. Cl.
*B66C 13/06* (2006.01)
*B66D 3/08* (2006.01)

(56) References Cited

U.S. PATENT DOCUMENTS

| | | | | |
|---|---|---|---|---|
| 3,977,530 | A | 8/1976 | Helm et al. | |
| 4,512,482 | A * | 4/1985 | Mentzer | B66C 23/702 212/300 |
| 4,537,317 | A * | 8/1985 | Jensen | B66C 23/74 212/301 |
| 4,595,108 | A * | 6/1986 | Koizumi | B66C 23/702 403/53 |
| 4,658,972 | A * | 4/1987 | Koizumi | B66C 23/702 212/230 |
| 4,967,917 | A * | 11/1990 | Koizumi | B66C 23/702 212/250 |
| 7,441,670 | B2 * | 10/2008 | Willim | B66C 23/66 212/300 |
| 2010/0243595 | A1 * | 9/2010 | Walker | B66C 23/26 212/294 |
| 2018/0037446 | A1 * | 2/2018 | Harauchi | B66C 23/66 |
| 2018/0118526 | A1 * | 5/2018 | Harauchi | B66C 23/702 |
| 2018/0118527 | A1 * | 5/2018 | Harauchi | B66C 23/42 |

* cited by examiner

AUXILIARY SHEAVE DEVICE AND CRANE INCLUDING THE SAME

TECHNICAL FIELD

The present invention relates to an auxiliary sheave device attached to a distal end portion of a derrick member of a crane and a crane including the auxiliary sheave device.

BACKGROUND ART

To the distal end of a derrick member of a crane, there may be attached an auxiliary sheave device that includes an auxiliary sheave and a member for supporting the auxiliary sheave. FIG. 2 of Patent Document 1 (JP 2018-70310) discloses an auxiliary sheave device including an auxiliary sheave and a mounting member. The mounting member is fixed to a jib that is a derrick member of a crane.

The auxiliary sheave device described in Citation 1, however, has a complex structure. Furthermore, the auxiliary sheave device described in the literature 1 has a large mass, which may limit the lifting capacity of the crane. These problems can occur in not only an auxiliary sheave device fixed to a jib as described above but also in an auxiliary sheave device mounted on a boom capable of derricking as well as the jib.

SUMMARY OF INVENTION

An object of the present invention is to provide an auxiliary sheave device capable of having a simple and lightweight structure and a crane including the auxiliary sheave device.

Provided are an auxiliary sheave device provided in a crane including a derrick member capable of being derricked with a vertically rotational movement thereof and a derrick member guy line connected to a distal end portion of the derrick member in order to derrick the derrick member, and a crane including the auxiliary sheave device. The auxiliary sheave device comprises: an auxiliary sheave frame attached to the distal end portion of the derrick member so as to be capable of making vertically rotational movement and taking a projecting posture of projecting beyond the distal end portion of the derrick member in a derrick-member distal-end direction that is a direction from a proximal end of the derrick member toward the distal end portion thereof, an auxiliary sheave guy line connected to a distal side portion of the auxiliary sheave frame and the derrick member to thereby keep the auxiliary sheave frame in the projecting posture, and an auxiliary sheave rotatably attached to the distal end portion of the auxiliary sheave frame and allowing an auxiliary hoisting rope to be applied to the auxiliary sheave.

DESCRIPTION OF EMBODIMENTS

An embodiment of the present invention will be described with reference to FIGS. 1 to 6.

Figure 1:
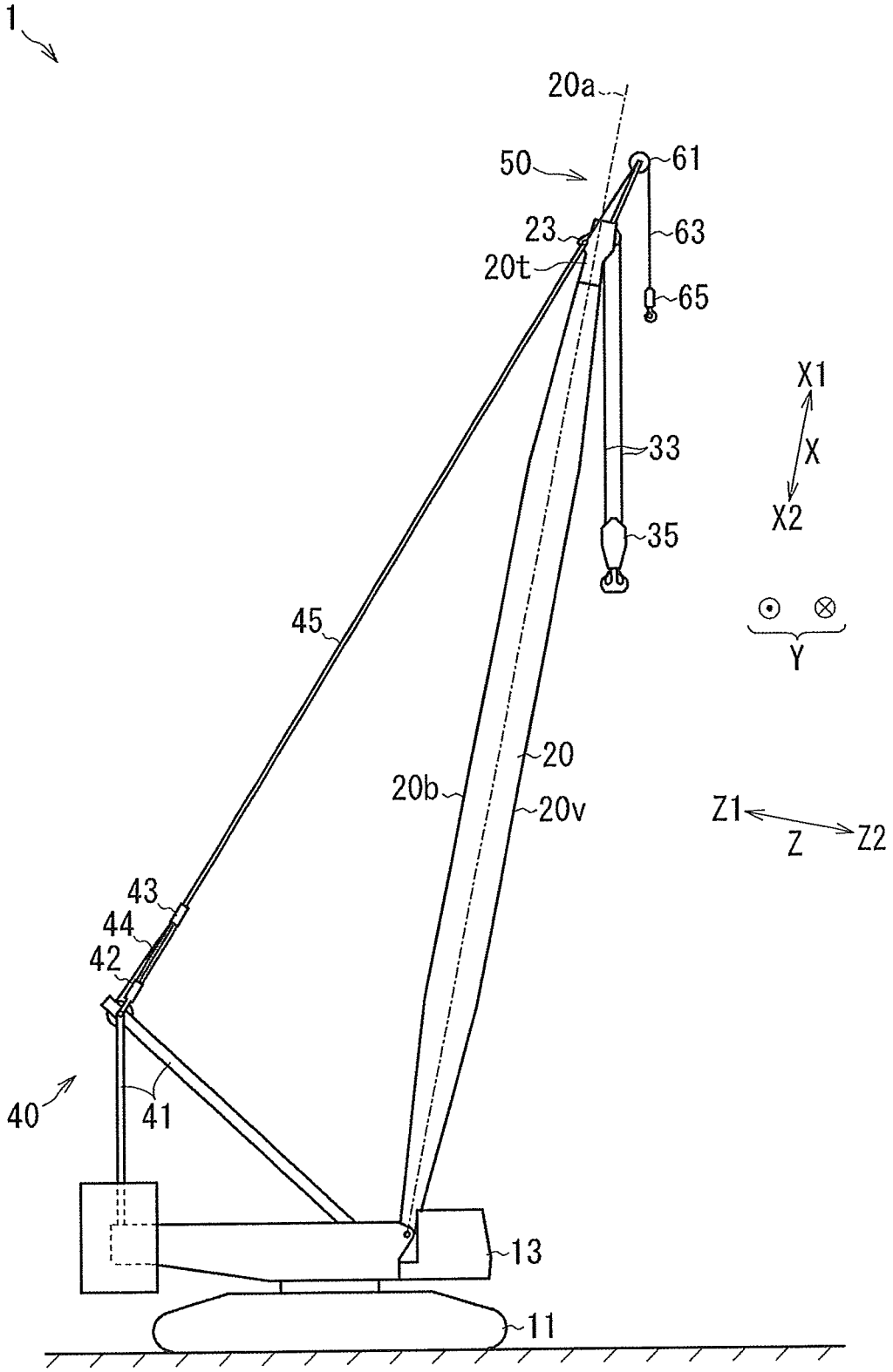
FIG. 1 is a side view of a crane according to an embodiment of the present invention.

FIG. 1 shows a claim 1 according to the embodiment. The crane 1 is a machine for performing work, namely, a work machine, for example, a construction machine for performing construction work. The crane 1 includes a lower travelling body 11, an upper slewing body 13, a boom 20, a boom derricking device 40, and an auxiliary sheave device 50. The lower travelling body 11 is capable of making travelling motion to move the entire crane 1. The upper rotating body 13 is mounted on the lower travelling body 11 so as to be capable of slewing relatively to the lower travelling body 11.

The boom 20 is a derrick member attached to the upper slewing body 13 so as to be capable of being derricked by vertically rotational movement thereof relative to the upper rotating body 13. The boom 20 may be either one having a lattice structure, namely, a lattice boom, or one having a box-shaped structure.

Figure 6:
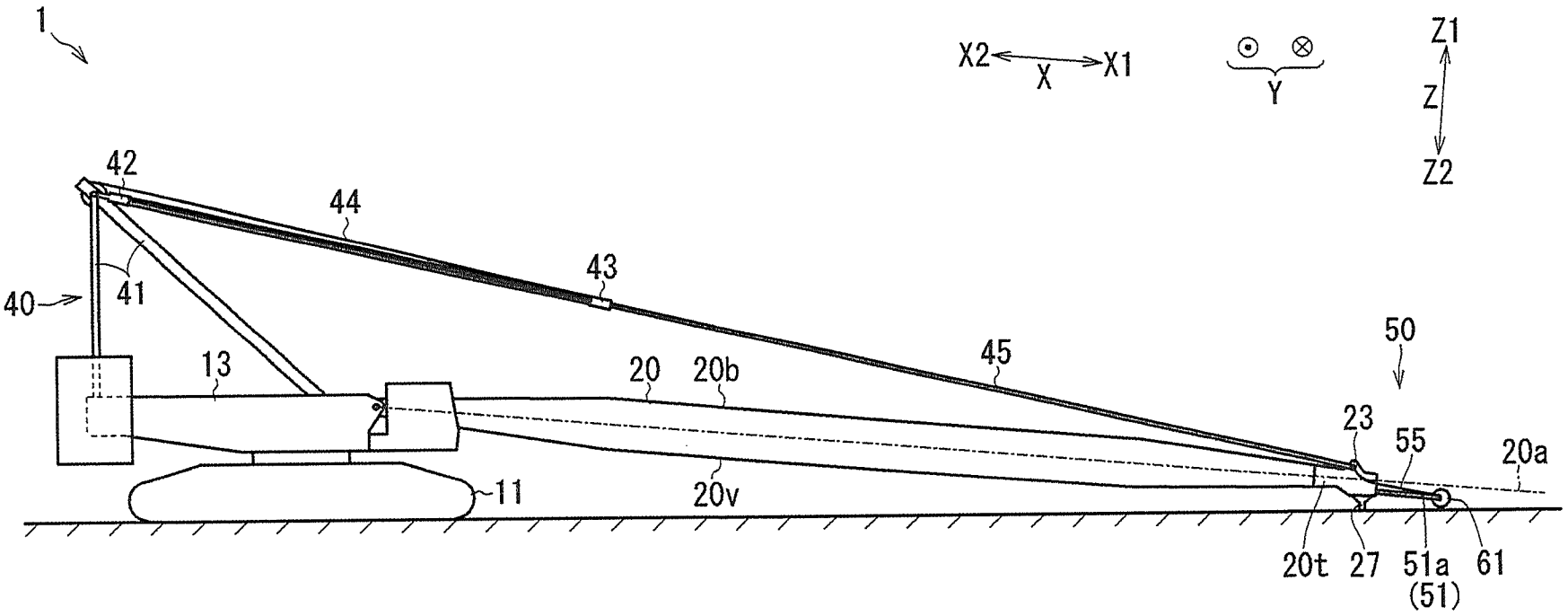
FIG. 6 is a side view showing a state where the boom is fallen down.

The boom 20 has a boom center axis 20*a*. The boom center axis 20*a* is a central axis of the boom 20, extending longitudinally of the boom 20. As shown in FIG. 6, the boom 20 is capable of taking a posture in which the boom center axis 20*a* extends horizontally or substantially horizontally, namely, a fallen posture. The boom 20 has a back surface 20*b* and a ventral surface 20*v*, which are surfaces facing up and down in the fallen posture, respectively.

Figure 2:
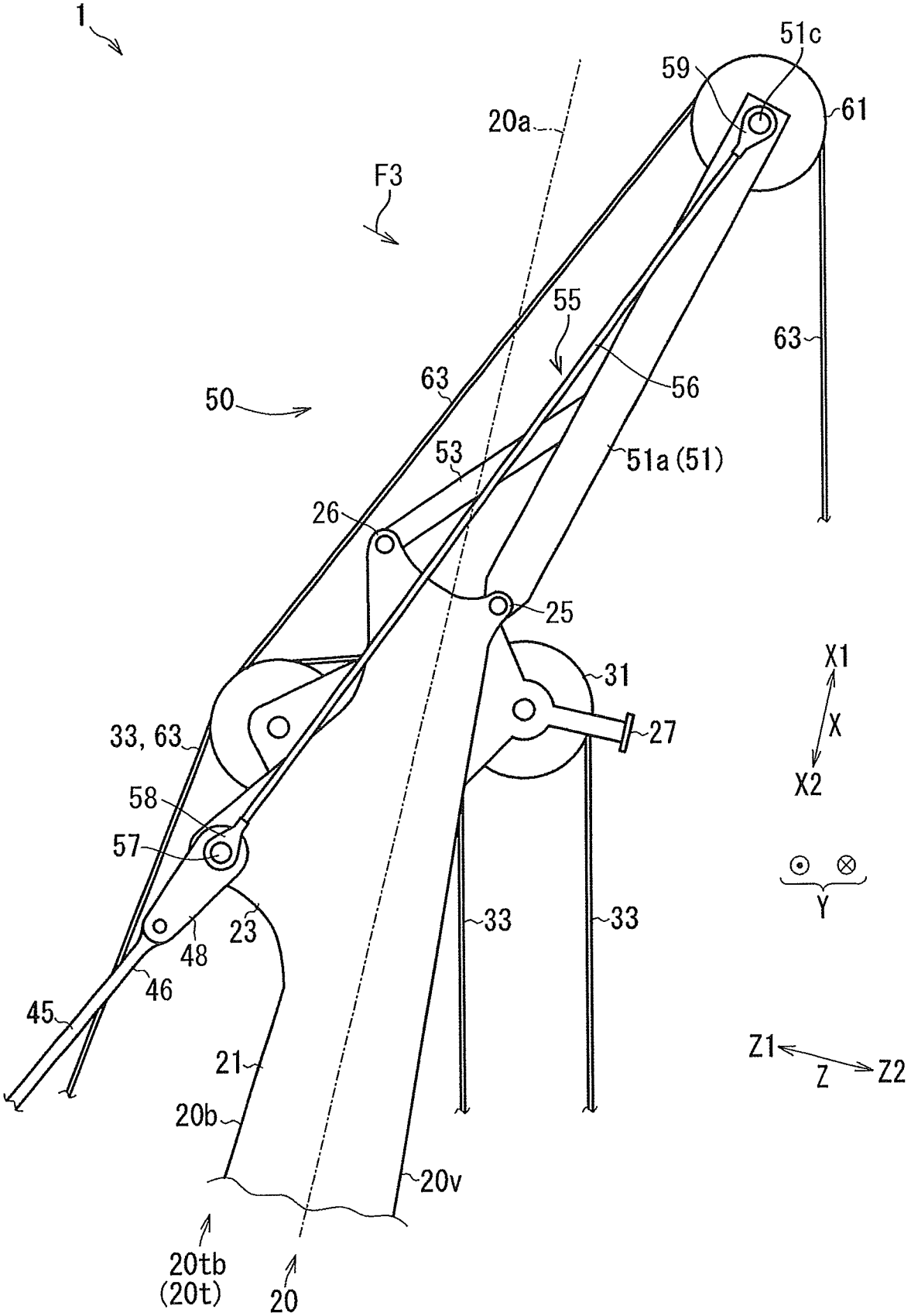
FIG. 2 is a side view showing a boom distal end portion of a boom of the crane and an auxiliary sheave device mounted thereon.

The boom 20 has a boom distal end portion 20*t*, which is the end in the distal direction X1 of the boom 20. As shown in FIG. 2, the boom distal end portion 20*t* includes a distal body 21, a pair of frame connection portions 25, a pair of backstop connection portions 26, a boom supporting leg 27, and a main sheave 31. In addition, to the boom distal end portion 20*t* are joined a pair of guy-line connection portions 23.

Figure 3A:
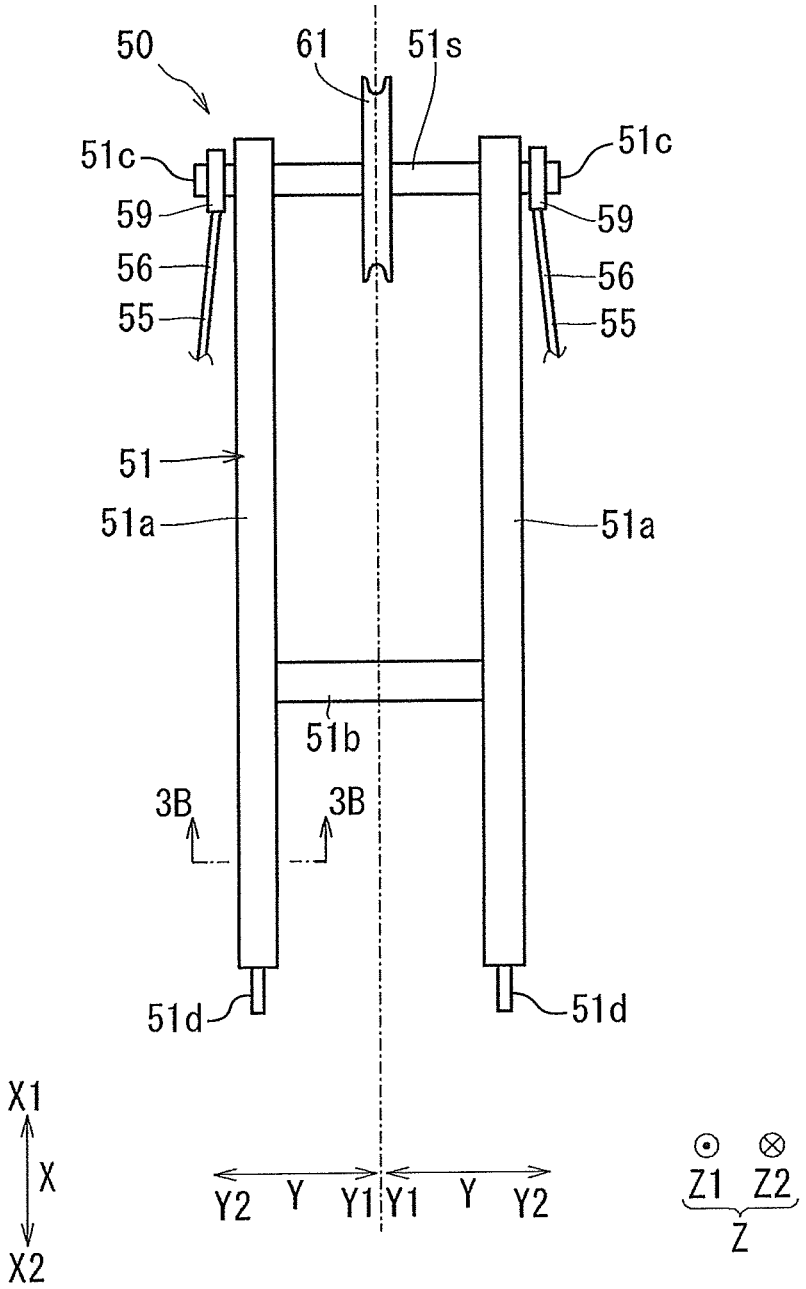
FIG. 3A is a rear view of the auxiliary sheave device along the arrow F3 shown in FIG. 2.

The following description contains three directions based on the boom 20, namely, a boom width direction Y, boom axis direction X and boom height direction Z. The boom width direction (derricking-member width direction) Y is a direction in which a motion center axis extends, the motion center axis being an axis around which the derricking motion (vertically rotational movement) of the boom 20 is made relatively to the upper turning body 13. The boom width direction Y includes a widthwise inward direction Y1 and a widthwise outward direction Y2 that are opposite to each other as shown in FIG. 3A. The widthwise inward direction Y1 is a direction of approaching the boom center axis 20*a* in the width direction Y, and the widthwise outward direction Y2 is a direction away from the boom center axis 20*a* in the width direction Y. The boom axis direction (derricking-member axis direction) X is a direction in which the boom center axis 20*a* extends, namely, the longitudinal direction of the boom 20. The boom axis direction X includes a boom distal direction X1 and a boom proximal direction X2 opposite thereto. The boom distal direction X1 is a direction from the proximal end of the boom 20 in the boom axis direction X, i.e. the end portion to be attached to the upper turning body 13, toward the distal end portion of the boom 20 opposite thereto, and the boom proximal direction X2 is a direction toward the proximal end portion from the distal end portion of the boom 20 in the boom axis direction X. The boom height direction Z is a direction perpendicular to each of the boom width direction Y and the boom axis direction X. The boom height direction Z includes a boom upward direction Z1 and a boom downward direction Z2 opposite thereto. The boom upward direction Z1 is a direction toward the back surface 20*b* from the ventral surface 20*v* in the boom height direction Z, and the boom downward direction Z2 is a direction toward the ventral surface 20*v* from the back surface 20*b* in the boom height direction Z.

The distal body 21 is a portion constituting the main body of the boom distal end portion 20*t*, and the pair of guy line connection portions 23, the pair of frame connection portions 25 and the pair of backstop connection portions 26 project outward beyond the distal body 21.

The pair of guy line connection portions 23 are arranged right and left, being portions to which a pair of derrick member guy lines included in the boom derricking device 40, namely, a pair of boom guy lines 45, and a pair of auxiliary sheave lines 55 included in the auxiliary sheave device 50 are connected, respectively. Each of the pair of guy line connection portions 23 projects from the back-surface side portion of the distal body 21 at a position closer to the proximal end of the boom 20 than the most distal end of the distal body 21 (that is, a position lower than the most upper end in FIG. 2) in the boom upward direction Z1 (substantially leftward in FIG. 2). The pair of guy line connection portions 23 are disposed on both sides of the boom distal end portion 20*t* in the boom width direction Y (right end portion and left end portions). The pair of guy line connection portions 23 are arranged symmetrically (or substantially symmetrically, hereinafter the same) in the boom width direction Y. The pair of frame connection portions 25 and the pair of backstop connection portions 26 are also arranged right and left in the same manner.

Figure 4:
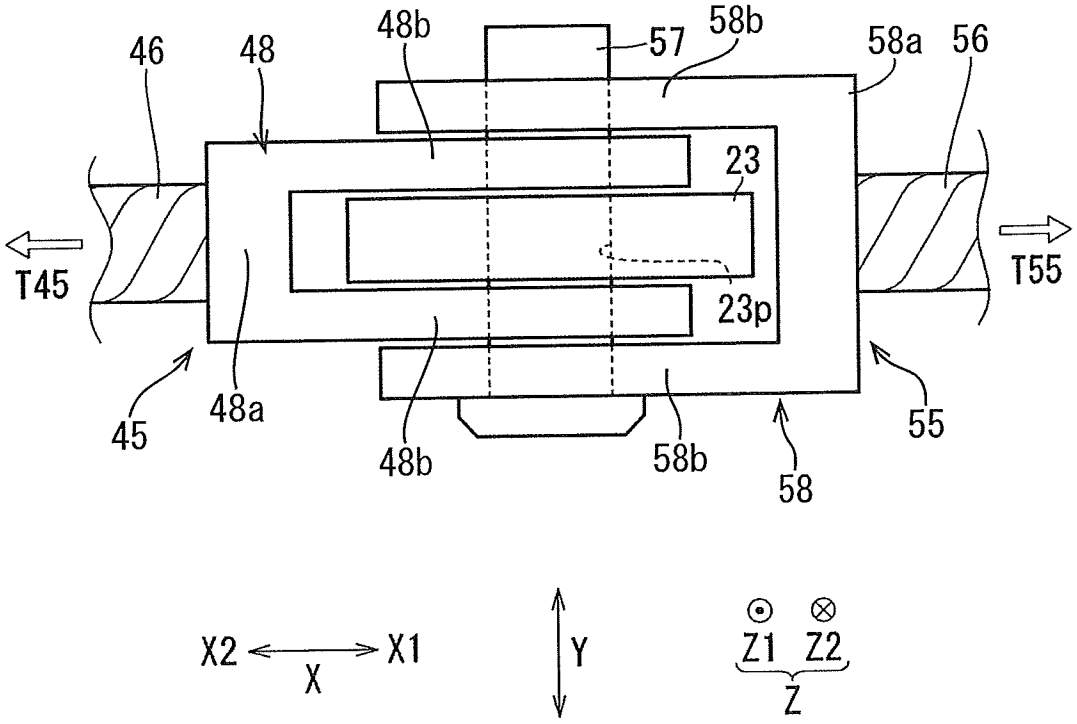
FIG. 4 is a plan view showing a guy line connection structure where respective ends of two guy lines are connected to a guy line connection portion included in the auxiliary sheave device along a boom falling direction.
Figure 5:
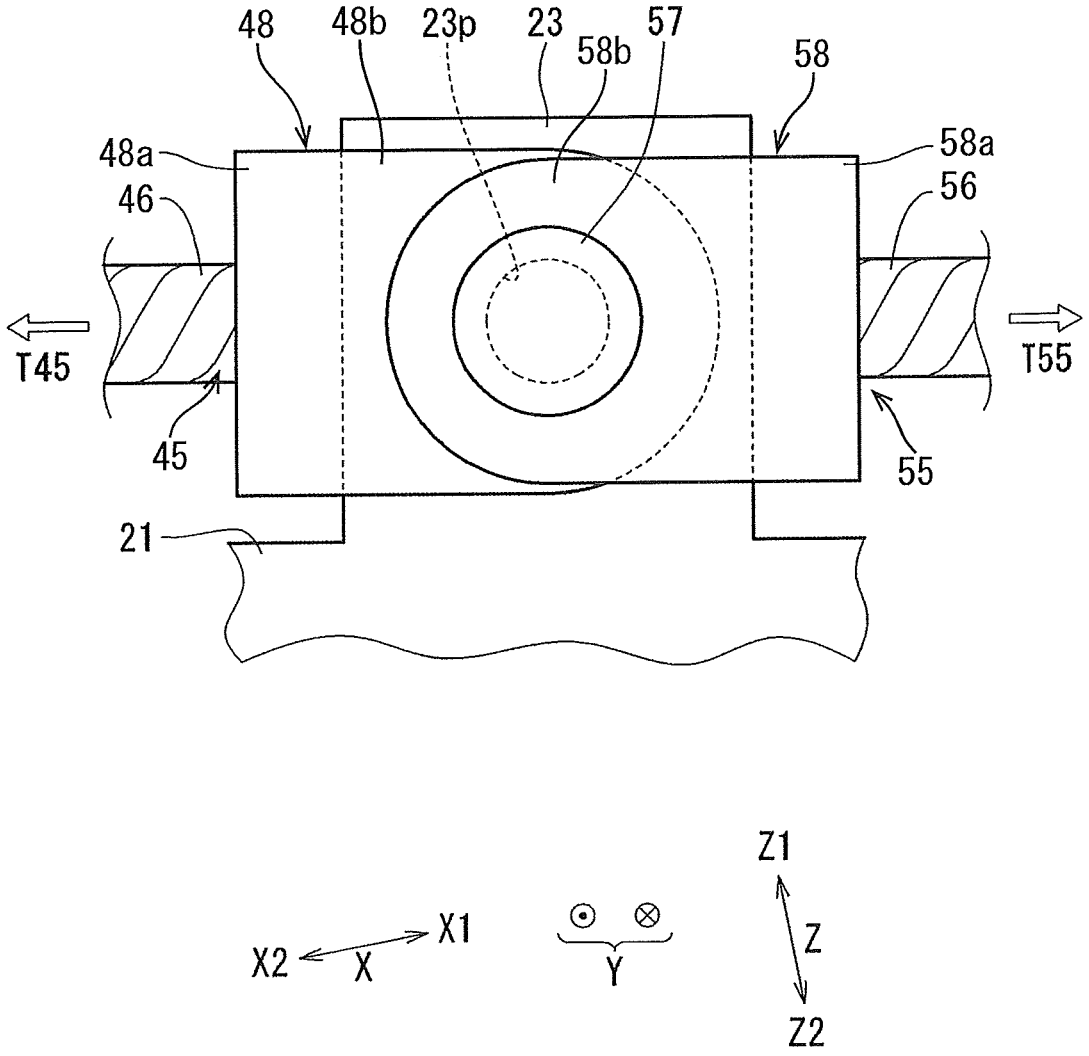
FIG. 5 is a side view showing the guy line connection structure shown in FIG. 4 along the boom lateral direction.

As shown in FIG. 4, each of the pair of guy line connection portions 23 according to this embodiment is a single plate-like member. However, each of the guy line connection portions 23 may be composed of a plurality of plate-like portions (for example, see the guy line connection portion 423 according to the modification 1 shown in FIG. 7). The shape of the guy line connection portions 23 when viewed along the boom width direction Y, namely, the side shape, is not limited. The side shape may be any of substantial triangular as shown in FIG. 2, substantially trapezoidal, and substantially rectangular as shown in FIG. 5. In FIG. 5, the shape of the guy line connection portions 23 has been modified, for convenience, from the shape shown in FIG. 2. Each of the guy line connection portions 23 is formed with a guy line mounting pin hole 23*p* shown in FIG. 4. The guy line mounting pin hole 23*p* has a shape that allows each of a pair of guy line connection pins 57 included in the auxiliary sheave device 50 to be inserted into the guy line mounting pin hole 23*p*, penetrating the member that constitutes the guy line connection portions 23 (e.g., plate-like member) in the boom width direction Y.

As shown in FIG. 2, the pair of frame connection portions 25 and the pair of backstop connection portions 26 are portions to which the auxiliary sheave device 50 is attached. The pair of frame connection portions 25 are disposed at respective positions that are close to the most distal end of the boom distal end portion 20*t*. The pair of frame connection portions 25 projects beyond a portion of the distal body 21, the portion being closer to the ventral surface 20*v* than the boom center axis 20*a* (the right side portion in FIG. 2) in the boom distal direction X1. The pair of backstop connection portions 26 are disposed at respective positions closer to the back surface 20*b* than the pair of frame connection portions 25, each of the position being the most distal position of the boom distal end portion 20*t*, and projects beyond the distal body 21 in the boom distal direction X1. Each of the pair of frame connection portions 25 and the pair of backstop connection portions 26 is formed with, for example, a pin hole.

The boom supporting leg 27 is a member that makes contact with the ground when the boom 20 is in the fallen posture as shown in FIG. 6 to thereby allow the boom 20 to be supported on the ground at the boom supporting leg 27. The boom supporting leg 27 projects from the distal body 21 in the boom downward direction Z2 (substantially rightward in FIG. 2) at a position slightly closer to the proximal end of the boom 20 than the pair of frame connection portions 25.

The main sheave 31 constitutes a main hoisting device for lifting and lowering a suspended load, with the main hoisting rope 33 shown in FIG. 1, a not-graphically-shown main hoisting winch and a main hook 35. The main sheave 31 is rotatably supported by the boom distal end portion 20*t* at a position where the main sheave 31 projects from the boom ventral surface portion of the boom distal end portion 20*t* in the boom downward direction Z2. The main hoisting rope 33 is a hoisting rope for suspending the main hook 35 from the main sheave 31 of the boom distal end portion 20*t*, being a wire rope. The main hoisting rope 33 is applied to the main sheave 31 to be guided by the main sheave 31. The main hoisting winch performs winding and feeding of the main hoisting rope 33, thereby lifting and lowering the main hook 35 and the suspended load hooked thereto.

The boom derricking device 40 is a device for derricking the boom 20 relatively to the upper turning body 13. The boom derricking device 40 includes a gantry 41, a lower spreader 42, an upper spreader 43, a boom derricking rope 44, the boom guy lines 45 (derrick member guy line) and a not-graphically-shown boom derricking winch.

The gantry 41 is mounted on the upper slewing body 13 so as to project upward beyond the upper rotating body 13. The lower spreader 42 includes a plurality of sheaves and a frame for supporting the sheaves, being supported at the distal end portion of the gantry 41. The upper spreader 43 includes a plurality of sheaves and a frame for supporting the sheaves, being disposed between the distal end portion of the gantry 41 and the boom distal end portion 20*t*. Specifically, the upper spreader 43 is connected to the lower spreader 42 through the boom derricking rope 44, while being connected to the boom distal end portion 20*t* through the pair of boom guy lines 45. The boom derricking rope 44 is a wire rope wound around the plurality of sheaves included in the lower spreader 42 and the plurality of sheaves included in the upper spreader 43. The boom derricking winch performs winding and feeding of the boom derricking rope 44 to change the interval between the lower spreader 42 and the upper spreader 43, thereby derricking the boom 20 to the upper slewing body 13.

The pair of boom guy lines 45 are disposed right and left. Each of the pair of boom guy lines 45 has a lower end portion (proximal-end side end portion) to be connected to the upper spreader 43 and an upper end portion to be connected to the boom distal end portion 20*t* (distal-end side end portion). The upper end portion, in details, is connected to the guy line connection portions 23 joined with a back surface portion 20*tb* of the boom distal end portion 20*t*.

Each of the pair of boom guy lines 45 is connected to the boom distal end portion 20*t* in order to derrick the boom 20. Specifically, as shown in FIG. 2, each of the pair of boom guy lines 45 includes a boom guy line body 46 and a first boom connection portion 48.

The boom guy line body 46 forms a linear shape in the used state thereof. The boom guy line body 46 includes one or both of a guy cable (wire rope) and a plurality of guy links connected to each other (e.g., plate-like link member, etc.). The boom guy line body 46 has a proximal-end side end portion, namely, a lower end portion, that is connected to the upper spreader 43. The specific structure of the boom guy line body 46 is not limited, only having to keep the interval between the boom distal end portion 20*t* and the upper spreader 43 constant in a state where the boom guy line body 46 is stretched, that is, in a state where a tension is acting thereon. The boom guy line body 46 preferably has a structure capable of being curved or bent when no tension is acting on the boom guy line body 46, such as the guy cable or the plurality of guy links. It is also acceptable that at least the boom guy line body 46 of at least one of the pair of boom guy lines 45 is unbendable.

The first boom connection portion 48 is a portion joined with the distal-end side end portion, namely, the upper end portion, of the boom guy line body 46, while being connectable to the guy line connection portions 23 of the boom distal end portion 20*t*, namely, a connector, serving as the first derrick member connection portion. As shown in FIG. 4, the first boom connection portion 48 according to this embodiment includes a base 48*a* joined with the boom guy line body 46 and a pair of pin insertion portions 48*b* extending from the base 48*a* to the side opposite to the boom guy line body 46. The pair of pin insertion portions 48 have respective plate shapes extending parallel to each other with a lateral interval therebetween. The first boom connection portion 48, alternatively, may include only a single plate-like portion in place of the pair of pin insertion portions 48*b* (see the boom guy line connection portion 848 in FIG. 14). Each of the pair of pin insertion portions 48*b* is formed with a pin hole penetrating the pin insertion portion 48*b* in the thickness direction thereof, that is, in the boom width direction Y.

The auxiliary sheave device 50, as shown in FIGS. 2 and 3A, includes an auxiliary sheave 61, an auxiliary sheave frame 51 attached to the boom distal end portion 20*t* while supporting the auxiliary sheave 61, a pair of backstops 53, the pair of auxiliary sheave guy lines 55, the pair of guy line connection pins 57 shown in FIG. 5, and the pair of guy line connection portions 23.

The auxiliary sheave frame 51 is a structure that supports the auxiliary sheave 61 while attached to the boom distal end portion 20*t*. The auxiliary sheave frame 51 is attached to the boom distal end portion 20*t* so as to be capable of rotational movement around the axis extending in the boom width direction Y. The auxiliary sheave frame 51 is capable of taking a projecting posture that is a posture of projecting beyond the boom distal end portion 20*t* in the boom distal direction X1. The projecting posture is, in other words, a posture where the auxiliary sheave frame 51 extends in a direction substantially parallel to the boom axis direction X. The auxiliary sheave frame 51 does not have to extend in a direction that exactly matches the boom axis direction X in the projecting posture. For example, in the posture shown in FIG. 2, when viewed along the boom width direction Y, the auxiliary sheave frame 51 is slightly inclined to the boom axis direction X so as to be displaced in the boom downward direction Z2 along the boom distal direction X1. The auxiliary sheave frame 51 is allowed to include at least one of a columnar member, a rod-shaped member and a plate-like member. The auxiliary sheave frame 51 may have a structure similar to the structure of the mast 741 shown in FIG. 13 as described later.

The auxiliary sheave frame 51 according to this embodiment includes, as shown in FIG. 3A, a pair of supports 51*a*, a first connection member 51*s* and a second connection member 51*b*. FIG. 3A is a view of the auxiliary sheave frame 51 and the like shown in FIG. 2 along the direction of the arrow F3, i.e. a plan view of the auxiliary sheave frame 51 and the like.

The pair of supports 51*a* are arranged right and left, specifically, being spaced in the boom width direction Y. The pair of supports 51*a* may be arranged so as to be either parallel to each other or slightly inclined to each other as the pair of supports 151*a* shown in FIG. 7. Each of the pair of supports 51*a* has a proximal end portion (a lower end portion in the projecting posture in the use state shown in FIGS. 2 and 3A) 51*d*, and a proximal end portion opposite thereto (an upper end portion in the projecting posture in the use state). The proximal end portion 51*d* is connected to each of the pair of frame connection portions 25 of the boom distal end portion 20*t* through, for example, a pin so as to be capable of rotational movement around the axis parallel to the boom width direction Y (vertically rotational movement). The proximal end portion 51*d* is a single plate-like portion in this embodiment, having a thickness direction coincident with the boom width direction Y.

Figure 3B:
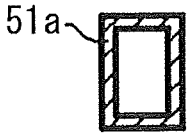
FIG. 3B is a diagram showing a cross section along the 3B-3B line in FIG. 3A.

Each of the pair of supports 51*a* may be either hollow or solid. The shape of the cross section seen along the cross section i.e. longitudinal direction of the support 51*a* is a rectangle as shown in FIG. 3B. The shape of the cross section, however, may be circular as shown in FIG. 8B. Each of the pair of supports 51*a* has a box shape as shown in FIG. 3A and FIG. 3B (a shape having a hollow rectangular cross section). Each of the pair of supports 51*a* however, may have a piped shape (a shape having a hollow circular cross section) like the support 251*a* shown in FIG. 8.

Each of the first and second connection members 51*s*, 51*b* is a support connection member interconnecting the pair of supports 51 in the boom width direction Y. The shape of each of the first and second connection member 51*s* may be, similarly to the support 51*a*, either of hollow, solid, a shape having a rectangular cross section or having a circular cross section. One of the first and second connection member 51*s*, Sib may be omitted. Alternatively, the auxiliary sheave device 50 may include, in addition to the first and second connection member 51*s*, 51*b*, another support connection member.

The first connection member 51*s* interconnects respective distal end portions of the pair of supports 51*a*, and the second connection member 51*b* interconnects respective intermediate portions of the pair of supports 51*a*. The first connection member 51*s* according to this embodiment includes, in addition to a main body portion that exists between the pair of supports 51*a*, respective portions projecting in the width outward direction Y2 from respective outer side surfaces with respect to the boom width direction Y, the portions forming a pair of auxiliary sheave guy line connection portions 51*c* to be connected with the pair of auxiliary sheave guy lines 55. Furthermore, the main body of the first connection member 51*s* supports the auxiliary sheave 61 rotatably around the axis extending in the boom width direction Y. The first connection member 51*s*, thus, has both of a function as a distal end connection member interconnecting respective distal end portions of the pair of supports 51*a* and a function as a sheave support member rotatably supporting the auxiliary sheave 61.

The pair of backstops 53, as shown in FIG. 2, restrain the auxiliary sheave frame 51 from excessive making rotational movement relative to the boom 20 beyond a predetermined angle in the same direction as the rising direction of the boom 20, namely, the upward direction Z1. The pair of backstops 53 is disposed between the boom distal end portion 20*t* and the auxiliary sheave frame 51. The pair of backstops 53 in this embodiment are disposed on the distal side of the guy line connection portions 23. The pair of backstops 53 are arranged right and left. Each of the pair of backstops 53 is preferably expandable and contractable longitudinally of the backstop 53. Specifically, preferable is one including at least one of a hydraulic cylinder and a spring. Each of the backstops 53, alternatively, may be configured to have an adjustable longitudinal length. The adjustment of the length allows the angle of the auxiliary sheave frame 51 to the boom distal end portion 20*t* (relative position) to be adjusted. Each of the pair of backstops 53, however, does not have to be expandable or contractable, and the length does not have to be adjustable.

The backstop 53 can be brought into respective contacts with the boom distal end portion 20*t* and the auxiliary sheave frame 51. Specifically, among the opposite ends of the pair of backstops 53 according to this embodiment, respective proximal end portions that are ends in the boom proximal direction X2 are attached (connected) to the pair of backstop connection portions 26 in the boom distal end portion 20*t*, respectively. On the other hand, respective distal end portions opposite to the proximal end portions of the pair of backstops 53 come into contact with the auxiliary sheave frame 51 at the time when the auxiliary sheave frame 51 makes rotational movement relative to the boom 20 in the boom upward direction Z1 by a predetermined angle, thereby preventing the auxiliary sheave frame 51 from excessive rotational movement. However, it is also acceptable that the distal end portion of the backstop 53 is connected to the auxiliary sheave frame 51 and the proximal end portion of the backstop 53 comes into contact with the boom distal end portion 20*t* at the time when the auxiliary sheave frame 51 makes rotational movement relative to the boom 20 in the boom upper direction Z1 by a predetermined angle. Alternatively, it is also acceptable that both of longitudinally opposite ends of the backstop 53, which is configured to be expandable and contractable, are connected to the auxiliary sheave frame 51 and the boom distal end portion 20*t*, respectively, and the contraction of the backstop 53 is prevented at the time when the backstop 53 is contracted by a predetermined length involved by the rotational movement of the auxiliary sheave frame 51 relative to the boom 20 in the boom upward direction Z1.

The pair of auxiliary sheave guy lines 55 is connected to the distal end portion 20*t* and to the distal side portion of the auxiliary sheave frame 51 to interconnect them so as to prevent the auxiliary sheave frame 51 from making rotational movement from the projecting posture as shown in FIG. 2 in the boom downward direction Z2 (clockwise direction in FIG. 2), i.e. the same direction as the falling direction of the boom 20. The distal side portion is a portion closer to the most distal end of the auxiliary sheave 61 than the longitudinally intermediate portion of the auxiliary sheave frame 51, being the pair of auxiliary sheave line connection portions 51*c* at the distal end portion of the auxiliary sheave frame 51 in this embodiment. The auxiliary sheave frame 51 can be kept in the projecting posture by the tension T55 of each of the pair of auxiliary sheave guy lines 55. Furthermore, in this embodiment, the limitation by the backstops 53 prevents the auxiliary sheave frame 51 from being greatly deviated from the projecting posture.

The pair of auxiliary sheave guy lines 55 are arranged right and left as shown in FIG. 3. Each of the pair of auxiliary sheave guy lines 55 includes an auxiliary sheave guy line body 56, a second boom connection portion 58, and an auxiliary sheave frame connection portion 59.

The auxiliary sheave guy line body 56 forms a straight-line shape in the used state thereof. The auxiliary sheave guy line body 56 includes, for example, one or both of a guy cable (wire rope) and a plurality of guy links connected to each other (e.g., plate-like link member). The specific structure of the auxiliary sheave guy line body 56 is not limited, only having to keep the distance between the boom distal end portion 20*t* and the distal end portion of the auxiliary sheave frame 51 constant in a state where the auxiliary sheave guy line body 56 is stretched, that is, a tension is acting thereon. The auxiliary sheave guy line body 56 preferably has a structure capable of being curved or bent freely in a state where no tension is acting thereon, such as the guy cable or the plurality of gai links.

The second boom connection portion 58 is a portion connected to the guy line connection portions 23 joined with the boom distal end portion 20*t* and connectable with the proximal end of the auxiliary sheave guy line body 56, that is, the connector serving as the second derrick member connection portion. In summary, the second boom connection portion 58 of the auxiliary sheave guy line 55 is connectable to the first boom connection portion 48 of the boom guy line 45 via the guy line connection portions 23 joined with the boom distal end portion 20*t*. As shown in FIG. 4, the second boom connection portion 58 according to this embodiment includes a base 58*a* joined with the proximal end of the auxiliary sheave guy line body 56, and a pair of pin insertion portions 58*b* extending from the base 58*a* to the side opposite to the auxiliary sheave guy line body 56. The pair of pin insertion portions 58*b* form respective plate shapes extending parallel to each other at lateral intervals. The second boom connection portion 58 may include only a single plate-like portion in place of the pair of pin insertion portions 58*b*. Each of the pair of pin insertion portions 58*b* is formed with a pin hole penetrating the pin insertion portion 48*b* in the thickness direction, that is, in the boom width direction Y.

The plate-like member forming each of the pair of guy line connection portions 23, thus, serves as a common guy line connection member that is a member joined with the boom 20 as the derrick member and includes both of a first guy line connection portion connectable with the first derrick member connection portion 48 and a second derrick member connection portion connectable with the second guy line connection portion 58.

Figure 9A:
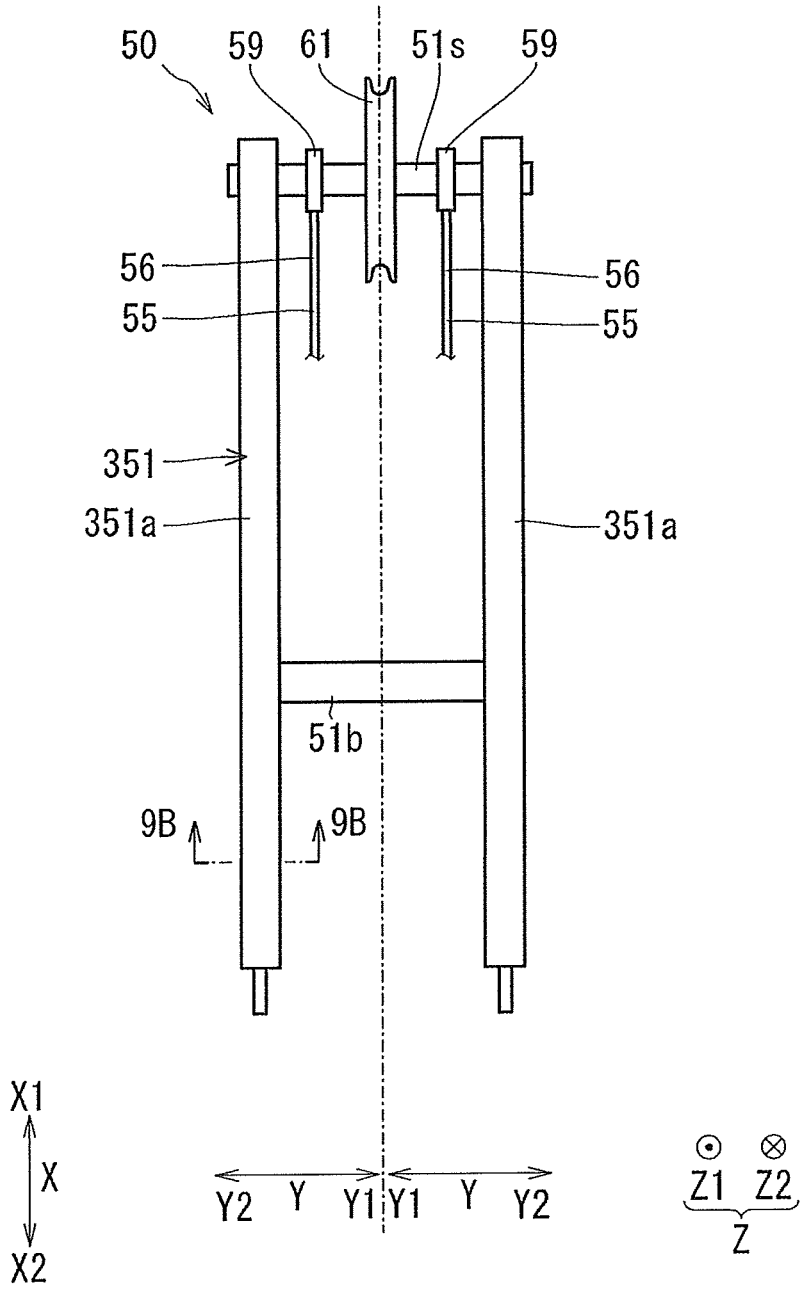
FIG. 9A is a plan view of an auxiliary sheave device according to Modification 3.

The auxiliary sheave frame connection portion 59 is, as shown in FIG. 2 and FIG. 3A, a portion joined with the distal end portion of the auxiliary sheave guy line body 56 while being connectable to the auxiliary sheave guy line connection portions 51*c* of the auxiliary sheave frame 51, namely, a connector. In short, the auxiliary sheave frame connection portion 59 in this embodiment is connectable to the distal end portion of the auxiliary sheave frame 51. The auxiliary sheave frame connection portion 59 is connected, more specifically, to the opposite ends of the first connection member 51*s*. The part to which the auxiliary sheave frame connection portion 59 is connected in the auxiliary sheave frame 51 is, however, not limited. The auxiliary sheave frame connection portion 59, for example, may be connected to the main body of the first connection member 51*s* as shown in FIG. 9A, i.e. the portion existing between the pair of supports 51*a*. The auxiliary sheave frame connection portion 59 may be connected, alternatively, to the pair of supports 51*a* or the second connection member 51*b*.

The pair of guy line connection pins 57 are pins for connecting, as shown in FIG. 4, respective first boom connection portions 48 of the pair of boom guy lines 45 and respective second boom connection portions 58 of the pair of auxiliary sheave guy lines 55 to the pair of guy line connection portions 23, respectively. Each of the pair of guy line connection pins 57 extends in the boom width direction Y. Each of the pair of guy line connection pins 57 is inserted into the guy line connection pin holes 23*p* of the guy line connection portions 23, the pin holes of the pair of pin insertion portions 48*b*, and the pin holes of the pair of pin insertion portions 58*b* in a state where, as shown in FIG. 4, the pair of pin insertion portions 48*b* of the pair of the first boom connection portions 48 is disposed on both sides of the pair of guy line connection portions 23 in the boom width direction Y and the pair of pin insertion portions 58*b* of the second boom connection portions 58 are disposed further on both sides of the pair of pin insertion portions 48*b*, that is, a state where the guy line connection portions 23 and the first and second boom connection portions 48 and 58 overlap each other in the boom width direction Y, thereby restraining the first and second boom connection portions 48 from displacement relative to the guy line connection portions 23. The guy line connection pin 57 according to this embodiment, thus, serves as a common guy line connection pin that is used for both of the connection of the first boom connection portion 48 to the guy line connection portion 23 and the connection of the second boom connection portion 58 to the guy line connection portion 23.

The auxiliary sheave 61 constitutes an auxiliary hoisting device for lifting and lowering a suspended load with an auxiliary hoisting rope 63 and an auxiliary hook 65 that are shown in FIG. 1 and further a not-graphically-shown auxiliary hoisting winch. The auxiliary sheave 61 is, as shown in FIG. 3, supported by the first connection member 51*s* at the distal end portion of the auxiliary sheave frame 51 rotatably about the first connection member 51*s* as the center axis. The auxiliary hoisting device may include a plurality of auxiliary sheaves 61 arranged in the boom width direction Y. The auxiliary hoisting rope 63 is a hoisting rope for suspending the auxiliary hook 65 from the auxiliary sheave 61, being a wire rope. The auxiliary hoisting rope 63 is applied to the auxiliary sheave 61 to be guided by the auxiliary sheave 61. The auxiliary hoisting winch performs winding and feeding of the auxiliary hoisting rope 63 to thereby lift and lower the auxiliary hook 65 and the suspension load hooked thereto. The number of winding of the auxiliary hoisting rope 63 on the auxiliary sheave 61 may be either one or more. In other words, the auxiliary hoisting rope 63 may be wound on a plurality of auxiliary sheaves 61. In general, the number of winding of the auxiliary hoisting rope 63 on the auxiliary sheave 61 is less than the number of windings of the main hoisting rope 33 on the main sheave 31. This enables the lifting speed of the auxiliary hook 65 to be higher than the lifting speed of the main hook 35.

The guy line connection structure shown in FIGS. 4 and 5 enables respective loads onto the pair of guy line connection portions 23 by the pair of boom guy lines 45 and by the pair of auxiliary sheave guy lines 55 to cancel each other. Details are as follows.

When the work of lifting a suspended load (crane work) is performed by the crane 1, the load due to mass of the boom 20 and the suspended load and the like causes tension in the boom guy line 45. Besides, when the work of suspending a suspended load by the auxiliary hook 65 is performed, a downward load by the suspension load acts on the auxiliary sheave 61 through the auxiliary volume rope 63 to cause a compressive force in the auxiliary sheave frame 51 in the longitudinal direction of the auxiliary sheave frame 51 (specifically the longitudinal direction of the pair of supports 51*a*), while causing a tension in each of the pair of auxiliary sheave guy lines 55. At this time, on the guy line connection portions 23 are acting a load due to the tension T45 in the boom guy line 45 and the load due to the tension T55 in the auxiliary sheave guy line 55 simultaneously, but respective directions of the two loads are opposite or substantially opposite to each other. This enables the loads to cancel each other. Specifically, respective loads due to the tension T45, T55 act on the guy line connection pin 57 simultaneously and cancel each other. This allows the load applied to the boom distal end portion 20*t* to be suppressed, thereby reducing the necessity for reinforcement of the boom distal end portion 20*t* to allow the boom distal end portion 20*t* to have a simpler structure. Respective loads due to the tension T45, T55, however, does not have to completely cancel each other (i.e. to make the combined force thereof zero); even only a partial cancel of the loads also can contribute to a simple structure of the boom distal end portion 20*t*.

The structure of the boom distal end portion 20*t* shown in FIG. 2 enables the auxiliary sheave frame 51 to be prevented from being subjected to a large load during the assembly or disassembly of the crane 1. Specifically, when the boom 20 is brought into the fallen posture shown in FIG. 6 for assembly or disassembly of the boom 20 and the boom derricking device 40, the boom supporting leg 27 of the boom distal end portion 20*t* can come into contact with the ground, involving the rotational movement of the auxiliary sheave frame 51 in the boom upper direction Z1 relative to the boom distal end portion 20*t*, thereby allowing the load on the boom 20 to be supported by the ground through the boom supporting leg 27. This makes it possible to prevent the auxiliary sheave frame 51 from receiving the load of the boom 20. Furthermore, the case of each of the pair of auxiliary sheave guy lines 55 having a structure capable of being curved or bent allows the auxiliary sheave frame 51 to make rotational movement in the boom upper direction Z1 even without the removal of the pair of auxiliary sheave lines 55 from the auxiliary sheave frame 51.

The backstop 53 is preferably configured to allow the auxiliary sheave frame 51 to make the above-described rotational movement in the boom upper direction Z1 relative to the boom distal end portion 20*t*. Specifically, it is preferable to configure the backstop 53 to impose no restriction on the auxiliary sheave frame 51 from making rotational movement in the boom upward direction Z1 when the falling down of the boom brings the auxiliary sheave 61 into contact with the ground. Alternatively, it is also preferable to separate the backstop 53 from at least one of the boom distal end portion 20*t* and the auxiliary sheave frame 51 when the boom 20 is fallen down.

The present invention is not limited to the embodiment described above. The present invention also encompasses modifications of the embodiments as follows. In the following description, the common feature of each modification and the above embodiment will be omitted.

(Regarding Modification of Auxiliary Sheave Frame 51)

Figure 7:
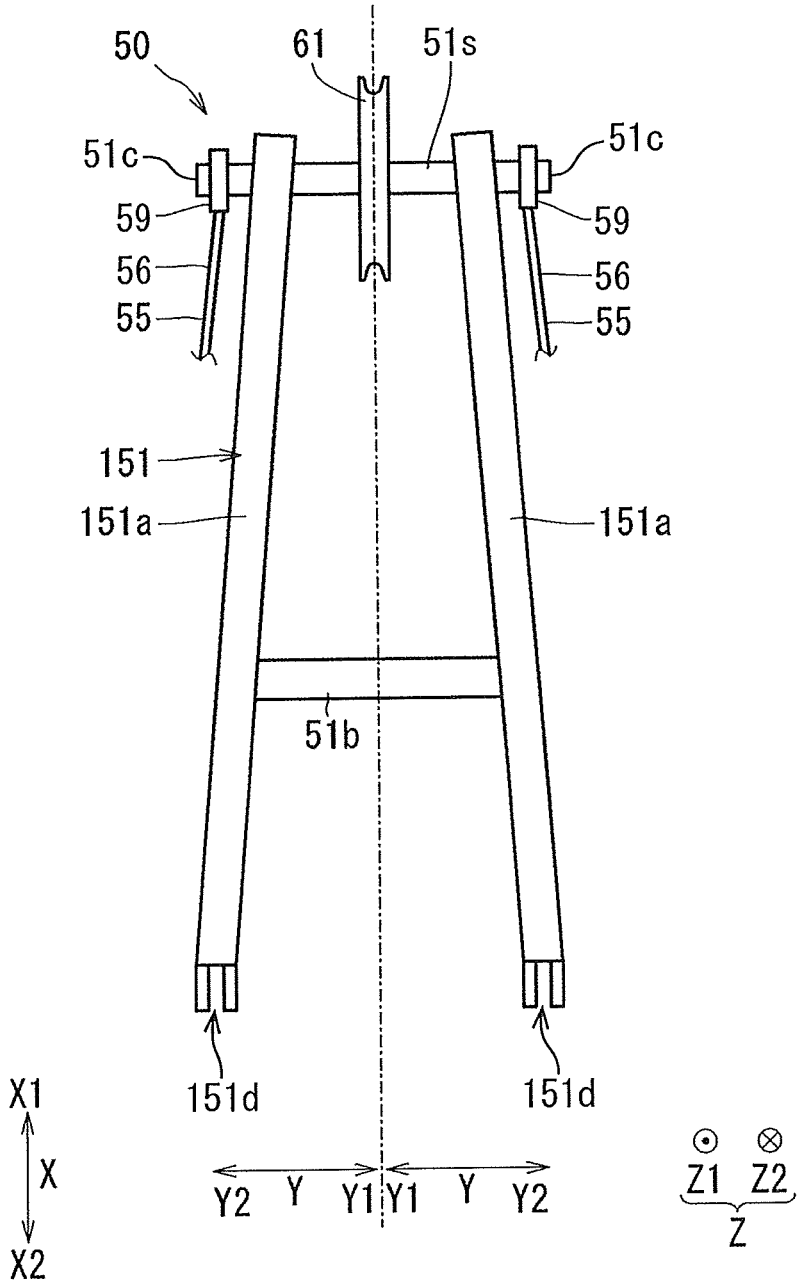
FIG. 7 is a plan view of an auxiliary sheave device according to modification 1.

FIG. 7 shows an auxiliary sheave frame 151 according to modification 1. While the auxiliary sheave frame 51 shown in FIG. 3 includes the pair of supports 51*a* that are arranged parallel to each other, the auxiliary sheave frame 151 shown in FIG. 7 includes a pair of supports 151*a* disposed in respective directions intersecting each other. Specifically, the pair of supports 151*a* shown in FIG. 7 is arranged so that the interval in the boom width direction Y between the pair of supports 151*a* is decreased toward the boom distal direction X1. Thus, in a mode where the auxiliary sheave frame includes a pair of supports, the pair of supports does not have to be parallel to each other.

Besides, respective proximal end portions 151*d* of the pair of supports 151*a*, i.e. the portions to be connected to the pair of frame connection portions 25 shown in FIG. 2, are formed of a pair of plate-like bodies spaced in the boom width direction Y. The pair of plate-like bodies, for example, are connectable to the frame connection portion 25, which is interposed between the pair of plate-like bodies.

Figure 8A:
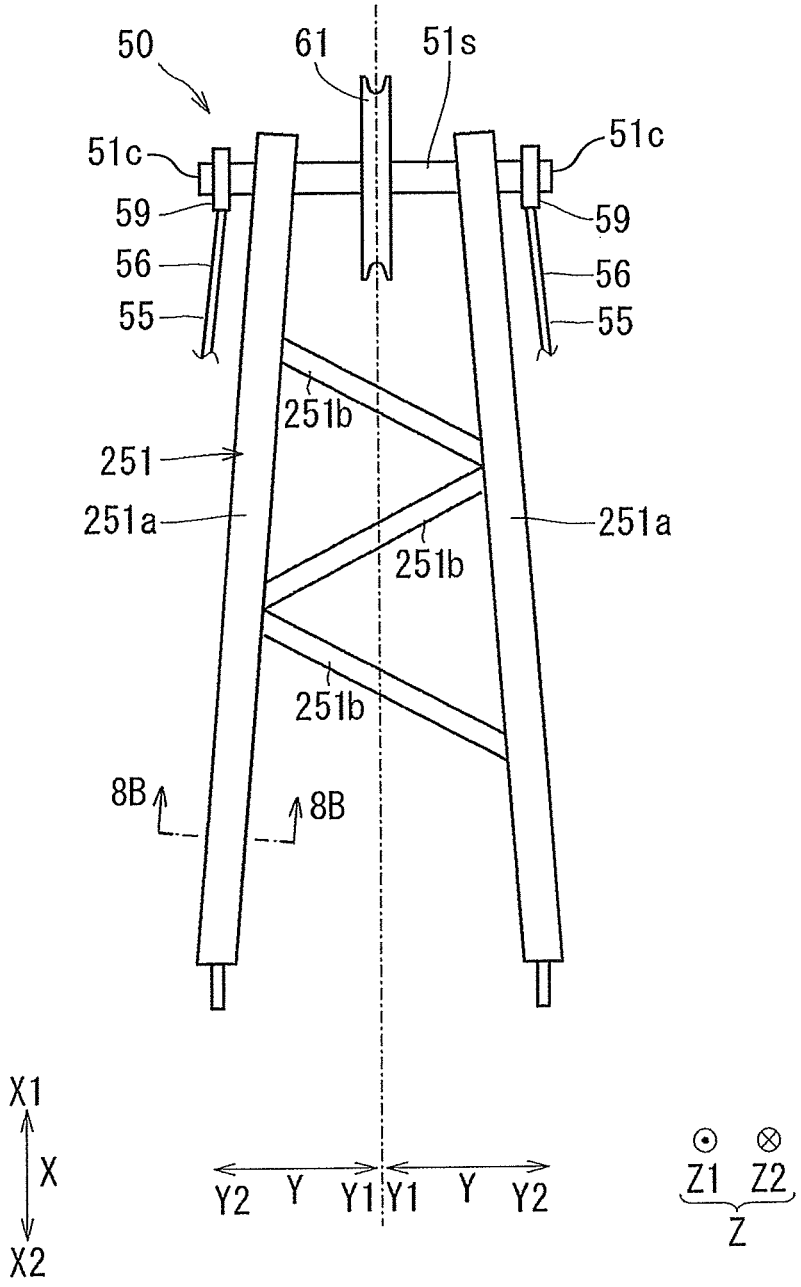
FIG. 8A is a plan view of an auxiliary sheave device according to Modification 2.
Figure 8B:
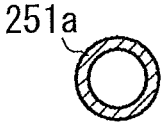
FIG. 8B is a diagram showing a cross section along the 8B-8B line in FIG. 8A.

FIGS. 8A and 8B show an auxiliary sheave frame 251 according to Modification 2. While each of the pair of supports 51*a* of the auxiliary sheave frame 51 shown in FIG. 3 has a box shape and the cross-sectional shape of the support 51*a* viewed in the longitudinal direction of the support 51*a* is a rectangle, the auxiliary sheave frame 251 shown in FIG. 8A includes a pair of supports 251*a* each being pipe-shaped (cylindrical). In other words, the cross-sectional shape of the support 251*a* viewed in the longitudinal direction of each of the pair of supports 251*a* is circular as shown in FIG. 8B. Thus, in the case of an auxiliary sheave frame including a pair of supports (the cross section in a direction perpendicular to the longitudinal direction), the shape of the cross section of each of the pair of supports is not limited.

The auxiliary sheave frame 251 shown in FIG. 8 includes a plurality of (three in FIG. 8A) second connection members 251*b* in place of a single second connection member 51*b* shown in FIG. 3. The plurality of second connection member 251*b* is arranged to constitute a so-called lattice structure. Thus, in the case of an auxiliary sheave frame including at least one connection member, the total number and specific arrangement of the at least one connection member are not limited.

Figure 9B:
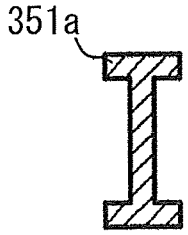
FIG. 9B is a diagram showing a cross section along the 9B-9B line in FIG. 9A.

FIGS. 9A and 9B show an auxiliary sheave frame 351 according to Modification 3. While the first connection member 51*s* of the auxiliary sheave frame 51 shown in FIG. 3 includes opposite end portions each projecting in the widthwise outward direction Y2 of the boom width direction Y beyond the pair of supports 51*a*, respectively, to serve as the auxiliary sheave guy line connection portion 51*c* to be connected to each of the pair of auxiliary sheave-frame connection portions 59, the auxiliary sheave frame 351 shown in FIG. 9 allows the auxiliary sheave frame connection portion 59 of the pair of auxiliary sheave lines 55 to be connected to respective portions located between a pair of supports 351*a* in the first connection member 51*s*, namely, body portion. Specifically, in the example shown in FIG. 9A, the auxiliary sheave frame connection portions 59 are connected to the first connection member 51*s* at respective positions on both sides of the auxiliary sheave 61 in the boom width direction Y. Thus, in the case where an auxiliary sheave frame connection portion of an auxiliary sheave guy line is connected to a first connection member supporting an auxiliary sheave, respective portions at which the auxiliary sheave frame connection portions are connected to the first connection member are not limited.

Besides, while the cross section viewed in the longitudinal direction of the pair of supports 51*a* shown in FIG. 3 is a hollow rectangle, the cross section viewed in the longitudinal direction of each of the pair of supports 351*a* shown in FIG. 9A is I-shaped as shown in FIG. 9B. The shape of the cross section, alternatively, may be H-shaped.

Figure 10A:
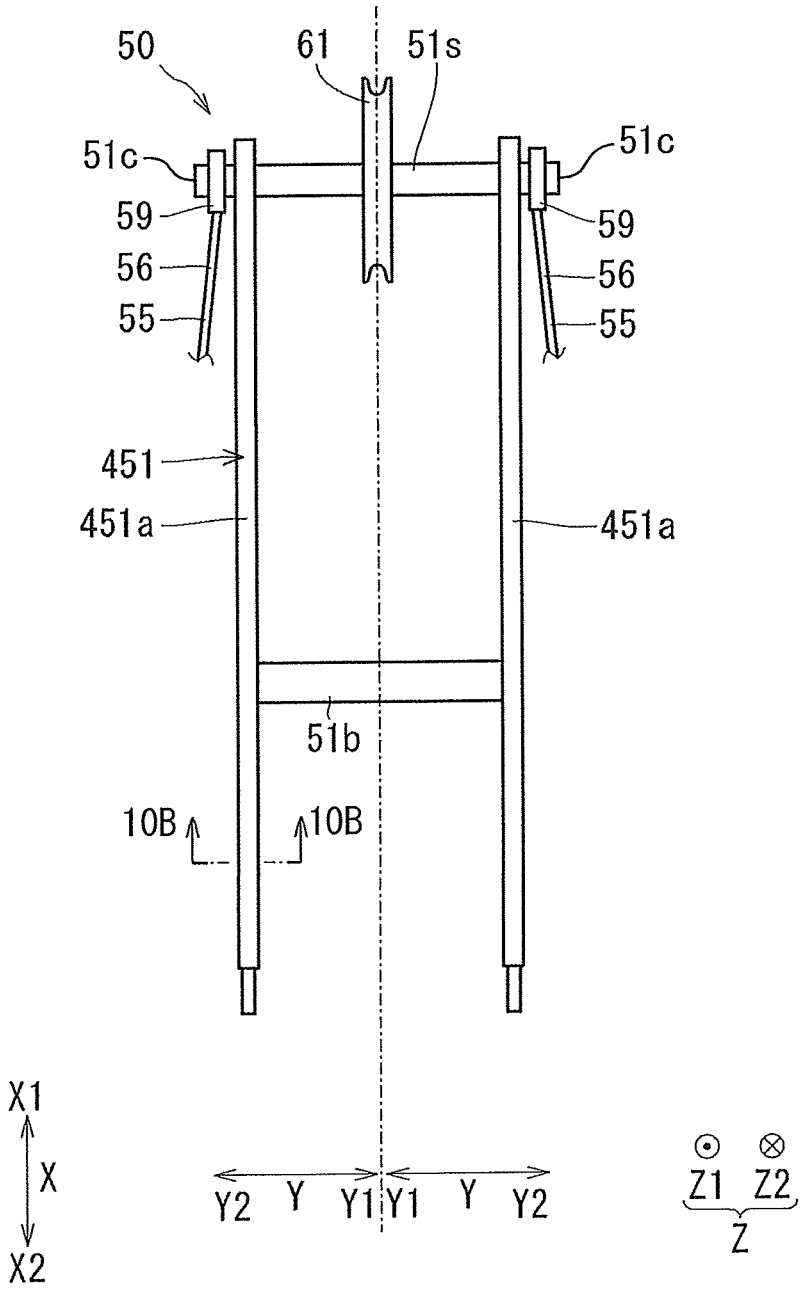
FIG. 10A is a plan view of an auxiliary sheave device according to modification 4.
Figure 10B:
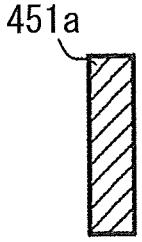
FIG. 10B is a diagram showing a cross section along the 10B-10B line in FIG. 10A.

FIG. 10A and FIG. 10B show an auxiliary sheave frame 451 according to Modification 4. While the cross section viewed in the longitudinal direction of each of the pair of supports 51*a* shown in FIG. 3 is a hollow rectangle, the auxiliary sheave frame 451 shown in FIG. 10A includes a pair of supports 451*a* each having a cross section of a solid rectangle viewed in the longitudinal direction as shown in FIG. 10B. Each of the pair of supports 451*a* has a plate shape extending in the boom axis direction X and in the boom height direction Z. Thus, in the case of an auxiliary sheave frame including a pair of supports, the cross section of each of the pair of supports may be solid.

Figure 11:
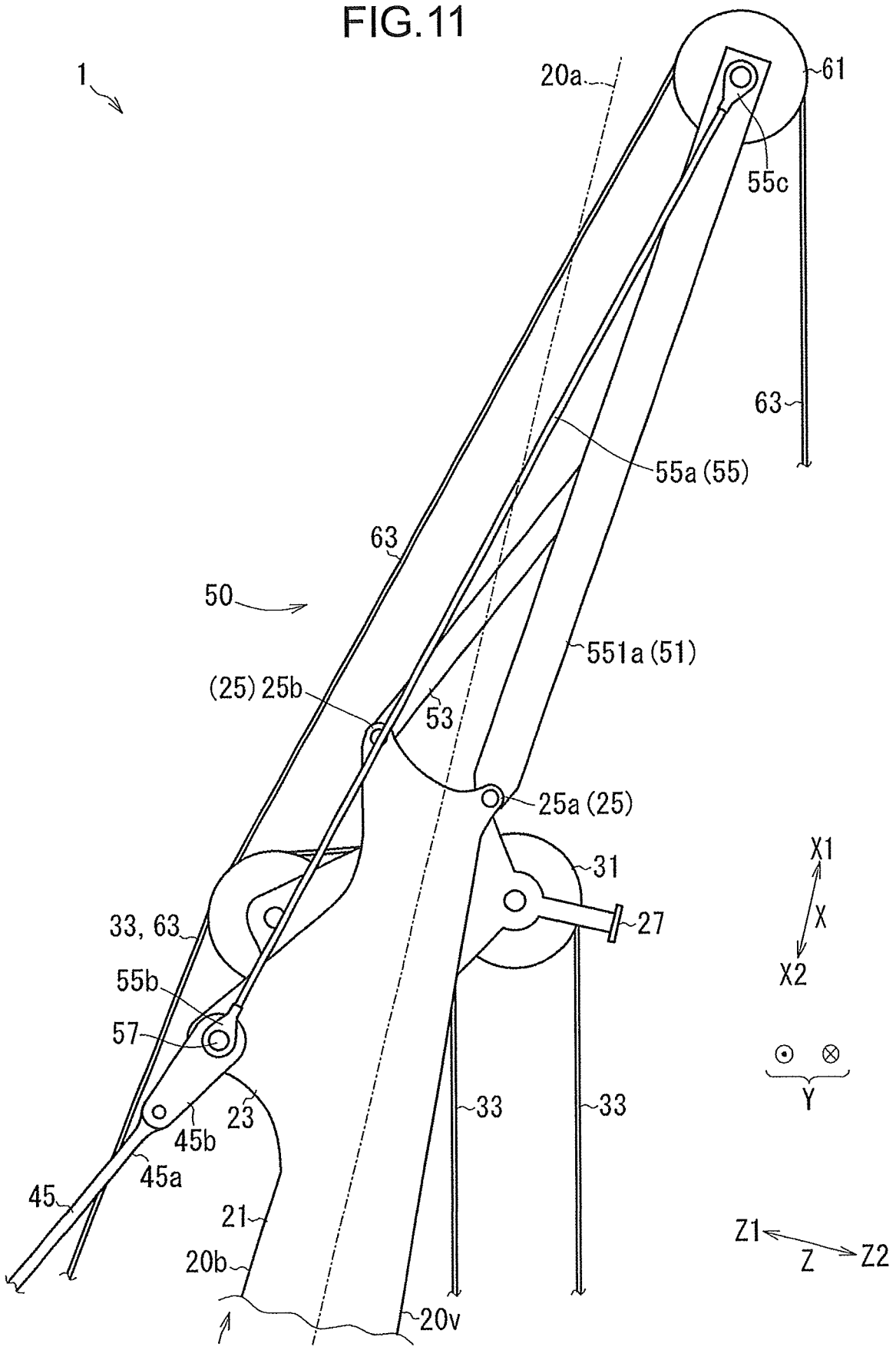
FIG. 11 is a side view of an auxiliary sheave device according to modification 5.

FIG. 11 shows an auxiliary sheave frame 551 according to Modification 5. Although the auxiliary sheave frame 551 has a pair of supports 551*a* in the same manner as the auxiliary sheave frame 51 shown in FIG. 2, each of the pair of supports 551*a* is longer than each of the pair of supports 51*a* shown in FIG. 2. For example, while the length of each of the pair of supports 51*a* shown in FIG. 2 is about four times the diameter of the auxiliary sheave 61, the length of each of the pair of supports 551*a* shown in FIG. 11 is about six times the diameter of the auxiliary sheave 61. Thus, in the case of an auxiliary sheave frame including a pair of supports, the length of each of the pair of supports is allowed to be set variously.

(Regarding Addition of Strut 659 and Modification of Auxiliary Sheave Guy Line 55)

Figure 12:
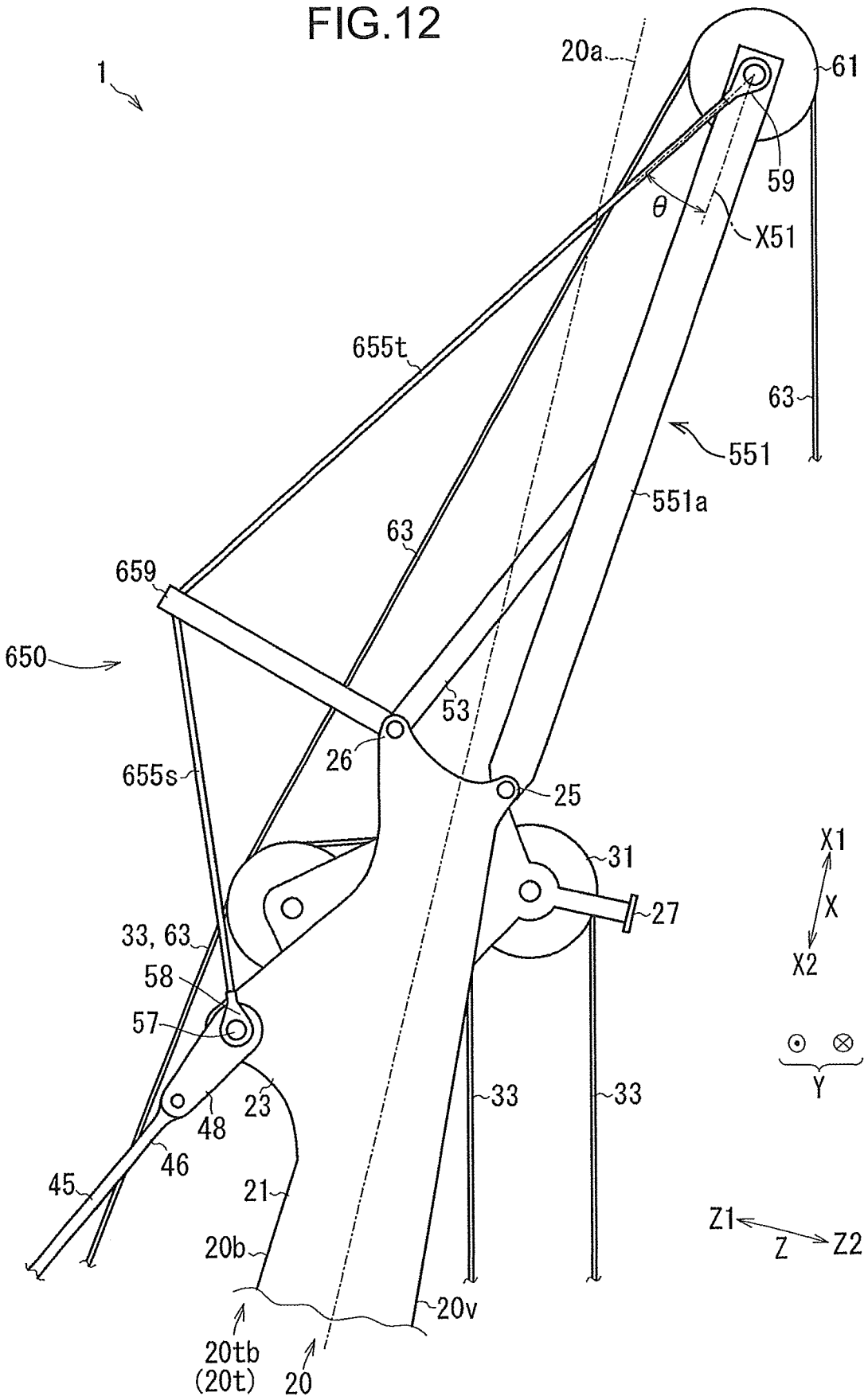
FIG. 12 is a side view of an auxiliary sheave device according to Modification 6.

FIG. 12 shows an auxiliary sheave device 650 according to Modification 6. The auxiliary sheave device 650 further includes a pair of struts 659. The auxiliary sheave device 650 includes a pair of first guy line members 655*s* and a pair of second guy line members 655*t* in place of the pair of auxiliary sheave guy lines 55 shown in FIG. 2. Each of the pair of the first guy line members 655*s* and each of the pair of the second guy line members 655*t* of the pair is disposed on the proximal-end side and on the distal-end side of the strut 659 in the boom axis direction X, respectively, as if forming a single auxiliary sheave guy line. Besides, the auxiliary sheave device 650 includes an auxiliary sheave frame 551 equivalent to the auxiliary sheave frame 551 according to the modification 5.

The pair of supports 659 are members for improving the suspension capacity of the auxiliary sheave device 650. Each of the pair of supports 659 reduces the tension acting on each of the first and second guy line members 655*s* and 655*t* connected thereto, thereby suppressing the compressive force acting on the auxiliary sheave frame 551. Specifically, the pair of supports 659 allows an auxiliary sheave guy line angle θ to be large as compared with the case of absence of the strut 659. The auxiliary sheave guy line angle θ is an angle formed between the center axis X51 of the auxiliary sheave frame 551 extending in the longitudinal direction of the auxiliary sheave frame 551, and the central axis of the second guy line member 655*t* that is a member connected to the auxiliary sheave frame 551 out of the first and second guy line members 655*s*, 655*t*, when viewed along the boom width direction Y.

The pair of supports 659 is disposed to be closer to the distal end of the boom than the pair of guy line connection portions 23, respectively, which are joined with the back surface portion 20*tb* of the boom distal end portion 20*t* and connectable with the pair of first guy line members 655*s*, respectively. The pair of supports 659 is directly or indirectly connected to the boom distal end portion 20*t* so as to project from the boom distal end portion 20*t* in the boom upward direction Z1 (upper left direction in FIG. 12). The pair of supports 659 shown in FIG. 12 are disposed right and left, being connected to a pair of backstop connection portions 26 as well as a pair of backstops 53. The pair of supports 659 may be either capable of rotational movement relative to the boom distal end portion 20*t* or fixed so as to be prevented from the rotational movement. The pair of supports 659, alternatively, can be connected to the auxiliary sheave frame 551 so as to be capable of rotational movement or fixed thereto so as to be prevented from the rotational movement. The auxiliary sheave device 650 may include only a single strut in place of the pair of supports 659.

The first and second guy line members 655*s*, 655*t* are connected to the pair of supports 659, respectively, so as to allow a force to be transmitted between the first and second guy line members 655*s*, 655*t*. Each of the pair of the first guy line members 655*s* has a proximal-end-side end portion to be connected to the guy line connection portion 23 and a distal-end-side end portion that is a portion opposite to the proximal-end-side end portion and connected to the distal end portion of each of the pair of supports 659. Each of the pair of the second guy line members 655*t* has a proximal-end-side end portion connected to each of the distal end portion of the pair of supports 659 and a distal-end-side end portion that is a portion opposite to the proximal-end-side end portion and connected to the distal end portion of the auxiliary sheave frame 51.

The distal end portion of each of the pair of supports 659 may be provided with a not-graphically-shown sheave to which a single auxiliary sheave guy line is applied. This "single auxiliary sheave guy line" is, for example, a guy cable used in place of the first and second guy line member 655*s*, 655*t*.

(Regarding Modification of the Entire Crane 1)

Figure 13:
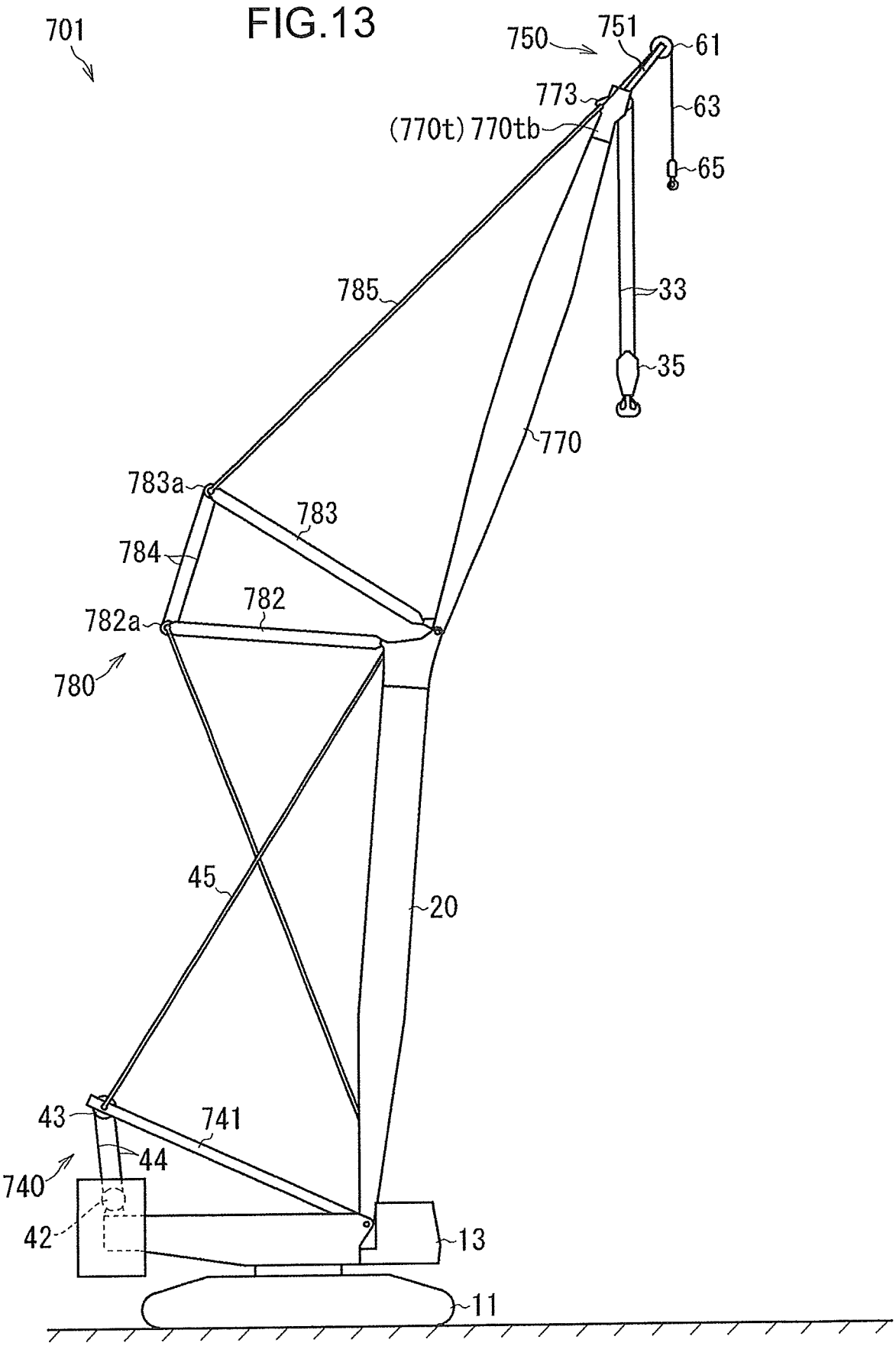
FIG. 13 is a side view of a crane according to modification 7.

FIG. 13 shows a crane 701 according to Modification 7. Similarly to the boom derricking device 40 shown in FIG. 2, the crane 701 is provided with a boom derricking device 740 including a lower spreader 42, an upper spreader 43, a boom derricking rope 44, a boom guy line 45 and a not-graphically-shown derricking winch; however, the boom derricking device 740 further includes a mast 741 in place of the gantry 41 shown in FIG. 1. The crane 701 further includes a jib 770, which is a derrick member, and a jib derricking device 780 that brings the jib 770 into derricking motion.

The mast 741 is mounted on an upper slewing body 13 of the crane 701 so as to be capable of being derricked. The lower spreader 42 is mounted on the rear end portion of the upper slewing body 13. The upper spreader 43 is mounted on the distal end portion of the mast 741. The boom guy line 45 is connected to the distal end portion of the mast 741 and to the distal end portion of the boom 20. The boom derricking rope 44 is wound around the lower spreader 42 mounted on the upper slewing body 13 and the upper spreader 43. The boom derricking winch performs winding and feeding the boom derricking rope 44 to change the interval between the lower spreader 42 and the upper spreader 43, thereby derricking the mast 741 to the upper slewing body 13. With the interconnection of the distal end portion of the boom 20 and the distal end portion of the mast 741 through the boom guy line 45, the derricked motion of the mast 741 to the upper slewing body 13 derricks the boom 20 to the upper slewing body 13.

The jib 770 as a derrick member is mounted on the distal end portion of the boom 20 so as to be capable of being derricked (capable of vertically rotational movement). The jib 770 may be either a lattice jib having a lattice structure or one having a box-shaped structure. The distal end portion of the jib 770, namely, a jib distal end portion 770*t*, is a derricking-member distal end portion having the same structure as the boom distal end portion 20*t* shown in FIG. 2. Specifically, with the jib distal end portion 770*t* is joined a guy line connection portion 773 similar to the guy line connection portions 23.

The jib derricking device 780 is a device for derricking the jib 770 relatively to the boom 20. The jib derricking device 780 includes a rear strut 782, a front strut 783, a jib derricking rope 784, a jib guy line 785, a not-graphically-shown jib derricking winch. The rear strut 782 and the front strut 783 are mounted on the distal end portion of the boom 20 so as to be capable of vertically rotational movement. The front strut 783, alternatively, may be mounted on the proximal end of the jib 770 so as to be capable of vertically rotational movement. The jib derricking rope 784 is wound around a rear sheave 782*a* rotationally mounted on the distal end portion of the rear strut 782 and a front sheave 783*a* rotationally mounted on the distal end portion of the front strut 783. The jib guy line 785 interconnects the front strut 783 and the jib distal end portion 770*t*. The jib derricking winch performs winding and feeding of the jib derricking rope 784 to change the interval between the rear strut 782 and the front strut 783, thereby rotate the front strut 783 into rotational movement relative to the boom 20. The rotational movement of the front strut 783 relative to the boom 20 causes the jib 770 to be derricked relatively to the boom 20.

The jib guy line 785 is, thus, a derricking-member guy line joined to the jib 770 to derrick the jib 770 relatively to the boom 20. The jib guy line 785 has a proximal end portion connected to the distal end portion of the front strut 783 and a distal end portion opposite thereto, the distal end portion connected to the jib distal end portion 770*t* through the guy line connection portion 773.

While the auxiliary sheave frame 51 of the auxiliary sheave device 50 according to the embodiment shown in FIG. 2 is attached to the boom distal end portion 20*t*, the auxiliary sheave device 750 shown in FIG. 13 includes an auxiliary sheave frame 751 attached to the jib distal end portion 770*t*. The auxiliary sheave device 750 is substantially equivalent to the auxiliary sheave 61 except that the derrick member to which the auxiliary sheave frame 751 is mounted is not the boom 20 but the jib 770. While the pair of auxiliary sheave lines 55 of the auxiliary sheave device 50 shown in FIG. 2 are connected to the guy line connection portions 23 in the back surface portion 20*tb* of the boom distal end portion 20*t*, the auxiliary sheave device 750 shown in FIG. 13 includes a pair of auxiliary sheave guy lines 55 but they are connected to the guy line connection portion 773 joined with a back surface portion 770*tb* of the jib distal end portion 770*t*.

(Regarding Modification of Guy Line Connection Structure)

The guy line connection structure shown in FIG. 2, that is, the structure for connecting the boom guy line 45 and the auxiliary sheave guy line 55 to the guy line connection portions 23, is variously modifiable.

Figure 14:
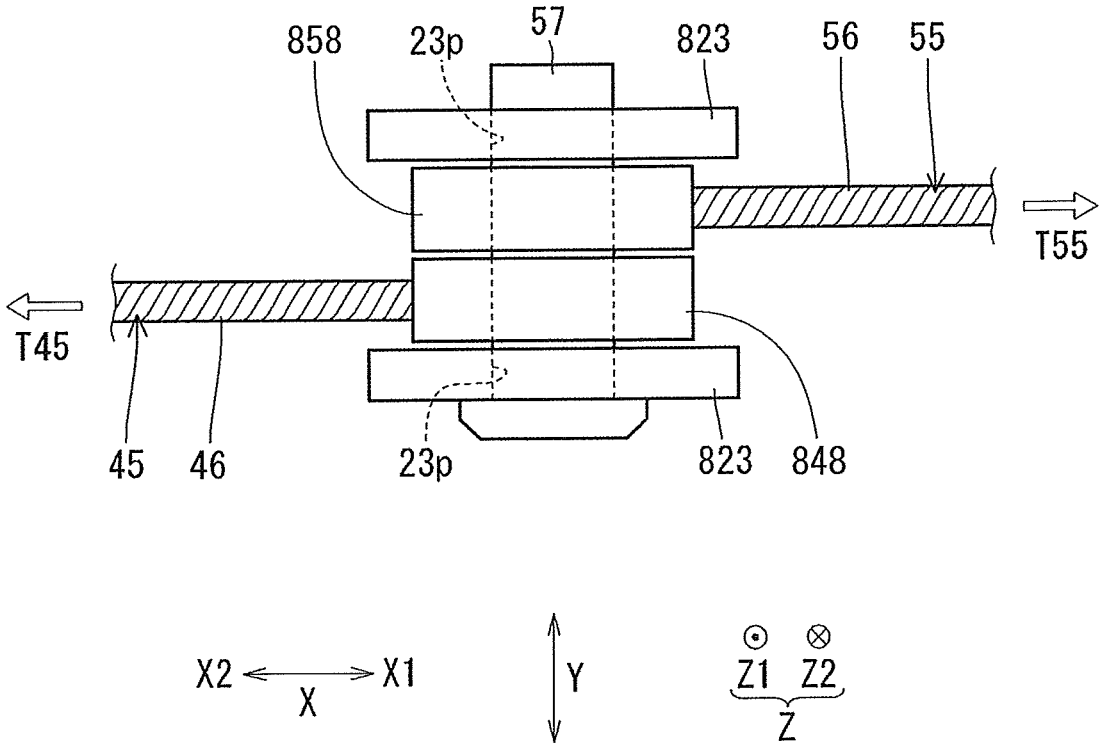
FIG. 14 is a plan view showing a guy line connection structure according to Modification 8.

FIG. 14 shows a guy line connection structure according to Modification 8. While the structure shown in FIG. 4 includes the guy line connection portions 23 on both sides of which in the boom width direction Y the pair of pin insertion portions 48*b* of the first boom connection portion 48 of the boom guy line 45 and the pair of pin insertion portions 58*b* of the second boom connection portion 58 of the auxiliary jib guy line 55 are disposed, the guy connection line structure shown in FIG. 14 includes a pair of plate-like guy line connection portions 823 arranged right and left (in the boom width direction Y), between which a first boom connection portion 848 of a boom guy line 45 and a guy line connection portion 823 of an auxiliary jib guy line 55 are disposed. Each of the first and second boom connection portions 848 and 858 is formed of a single plate-like member that is formed with a pin hole allowing a guy line connection pin 57 to be inserted into the pin hole. Alternatively, it is also possible to provide another guy line connection portion between the first boom connection portion 848 and the second boom connection portion 858. The guy line connection pin 57 also serves as the common guy line connection pin penetrating the first and second boom connection portion 848, 858 and the guy line connection portion 823, which overlap each other in the boom width direction Y. Besides, the plate-like member forming each of the pair of guy line connection portions 823 according to the modification 8 also serves as the common guy line connection member including both the first guy line connection portion and the second guy line connection portion.

Figure 15:
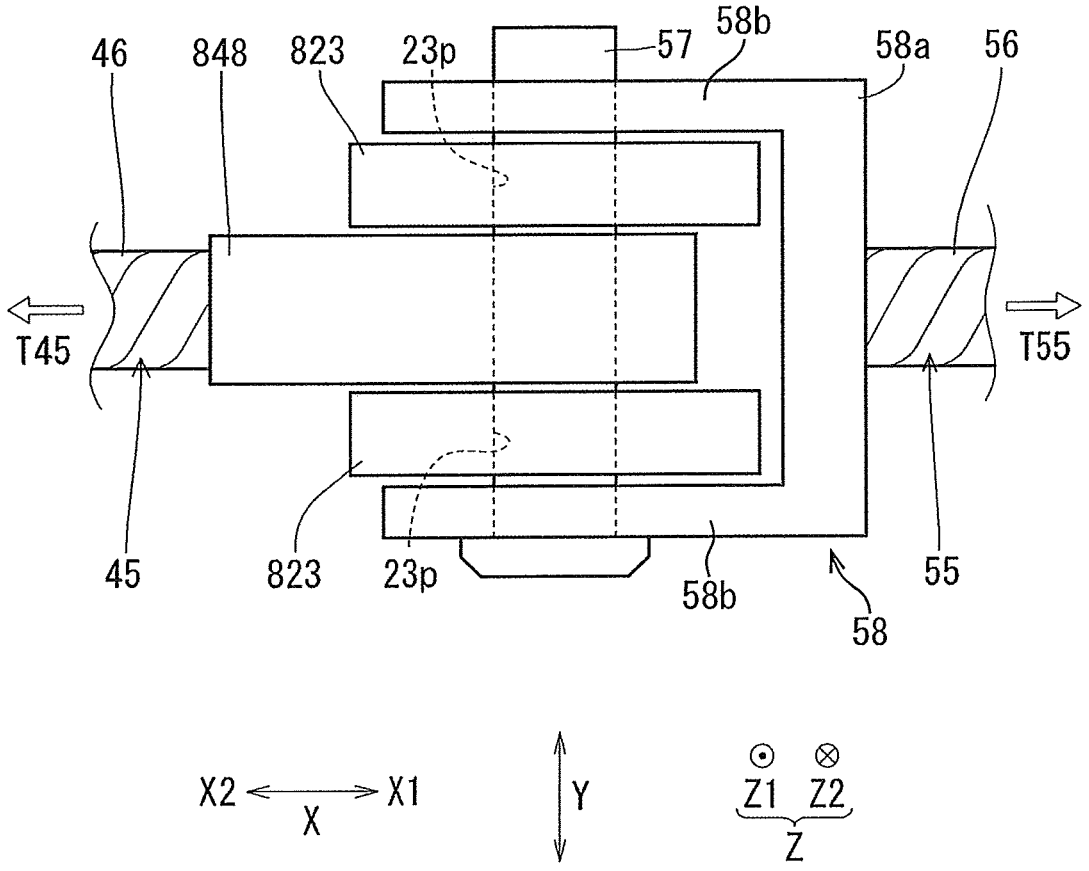
FIG. 15 is a plan view showing a guy line connection structure according to Modification 9.

FIG. 15 shows a guy line connection structure according to Modification 9. This structure includes a pair of guy-line connection portions 823 arranged right and left, a first boom connection portion 848 (of a boom guy line 45) formed of a single plate-like member, a second boom connection portion 58 that includes a base 58*a* and a pair of pin insertion portions 58*b* (of an auxiliary jib guy line 55) similarly to the second boom connection portion 58 shown in FIG. 5. The first boom connection portion 848 is disposed between (inside) the pair of guy line connection portions 823, while the pair of pin insertion portions 58*b* of the second boom connection portion 58 are disposed on both sides of the guy line connection portion 823 in the boom width direction Y. Alternatively, contrary to the modification 9, it is also possible that a second boom connection portion 58 formed of a single plate-like member is disposed between the pair of guy line connection portions 823 while the first boom connection portion 848 includes a pair of pin insertion portions, which are disposed on both outer sides of each of the pair of guy line connection portions 823.

Figure 16:
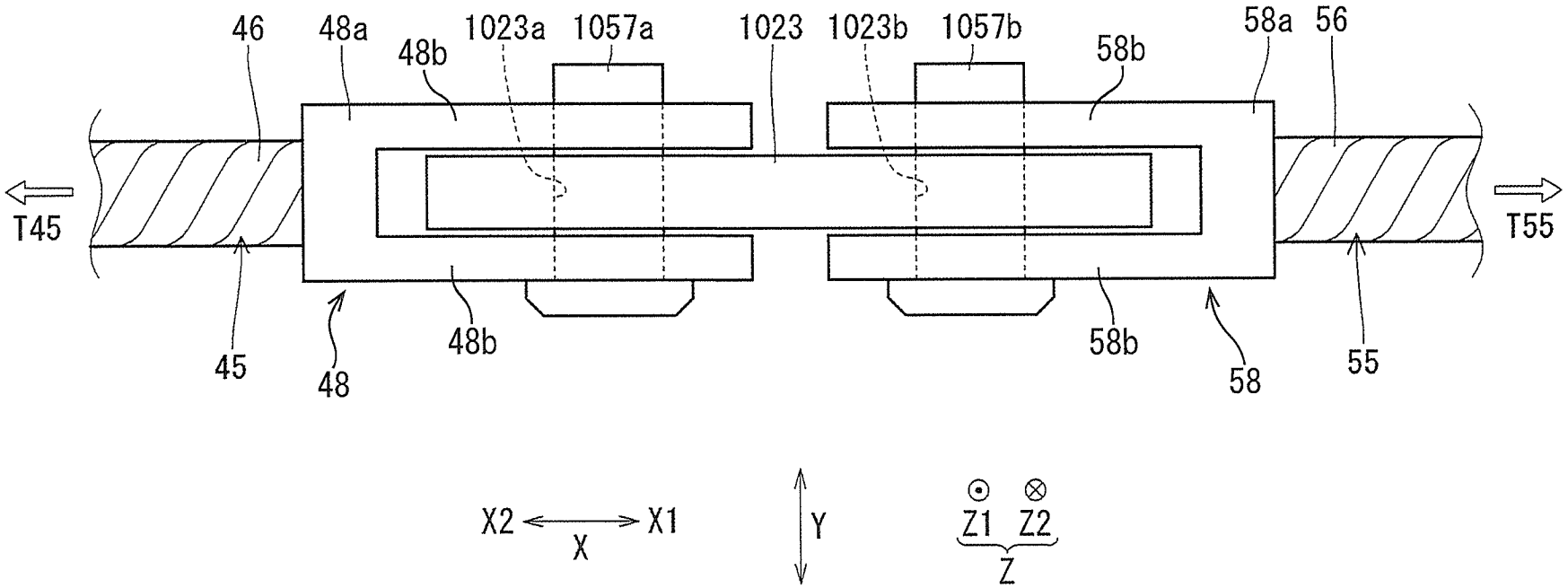
FIG. 16 is a plan view showing a guy line connection structure according to modification 10.
Figure 17:
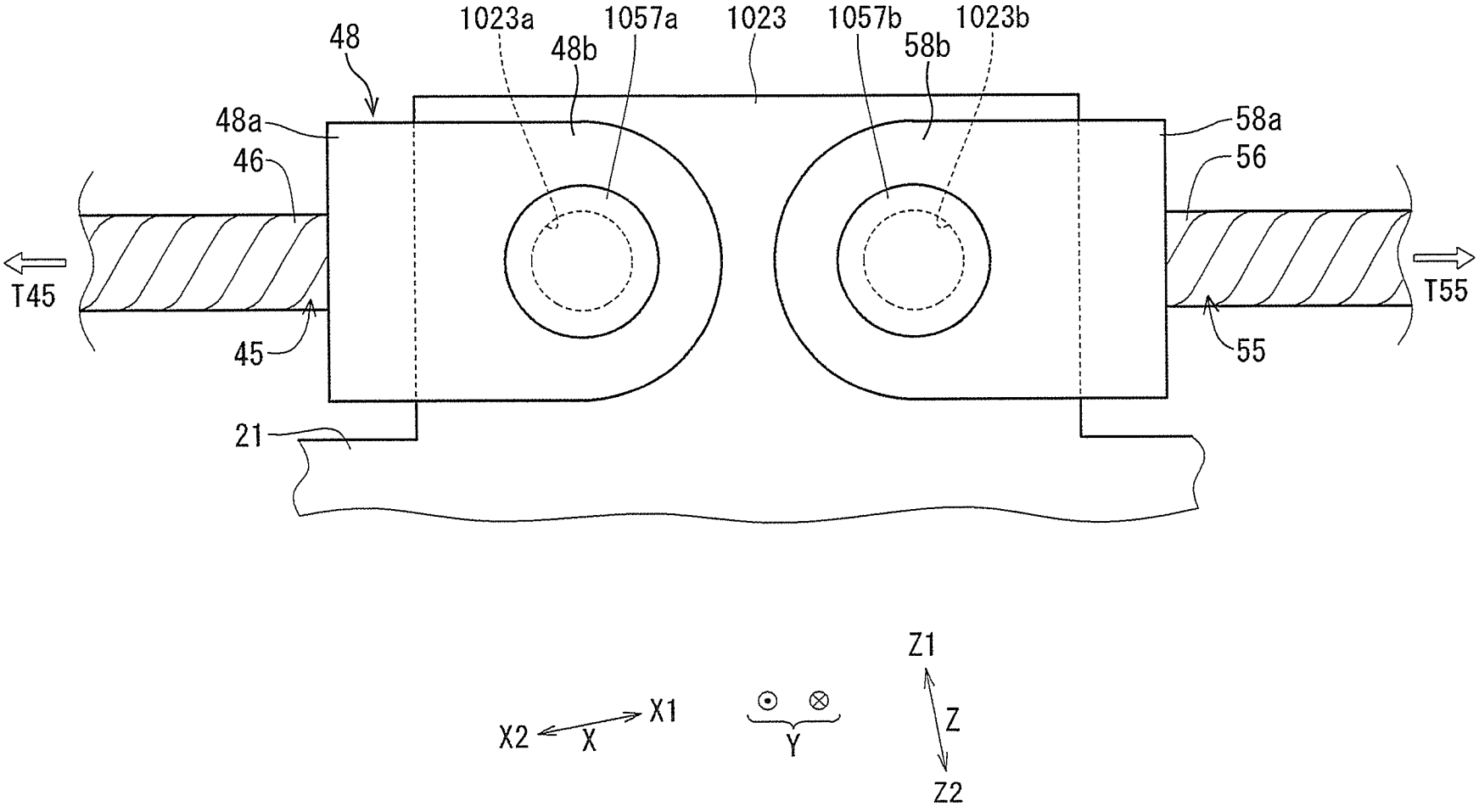
FIG. 17 is a side view showing a guy line connection structure according to modification 10.

FIGS. 16 and 17 show a guy line connection structure according to modification 10. While the structure shown in FIGS. 4 and 5 allows the first boom connection portion 48 and the second boom connection portion 58 to be connected to a common guy line connecting portion 23 through a common guy line connection pin 57, FIG. 16 and FIG. 17 show a first boom connection portion 48 and a second boom connection portion 58 that are connected to a common guy line connection portion 1023 through a first connection pin 1057*a* and a second connection pin 1057*b*, respectively, the first and second connection pins 1057*a*, 1057*b* being independent of each other. Specifically, the first connection pin 1057*a* interconnects the first boom connection portion 48 and the guy line connection portion 1023, and the second connection pin 1057*b* interconnects the second boom connection portion 58 and the guy line connection portion 1023. The guy line connection portion 1023 is formed with a first connection pin hole 1023*p* that allows the first connection pin 1057*a* to be inserted through the first connection pin hole 1023*p* and a second connection pin hole 1023*q* that allows the second connection pin 1057*b* to be inserted through the second connection pin hole 1023*q*. The first and second connection pin holes 1023*p*, 1023*q* are aligned and spaced in the boom axis direction X. Between the first connection pin 1057*a* and the second connection pin 1057*b*, the (e.g., plate-like) guy line connection portion 1023 is interposed. This enables a load acting on the guy line connection portion 1023 due to the tension T45 of the boom guy line main body portion 46 joined with the first boom connection portion 48 and a load acting on the guy line connection portion 1023 due to the tension T55 of the auxiliary sheave guy line main body 56 joined with the second boom connection portion 58 to cancel each other.

Figure 18:
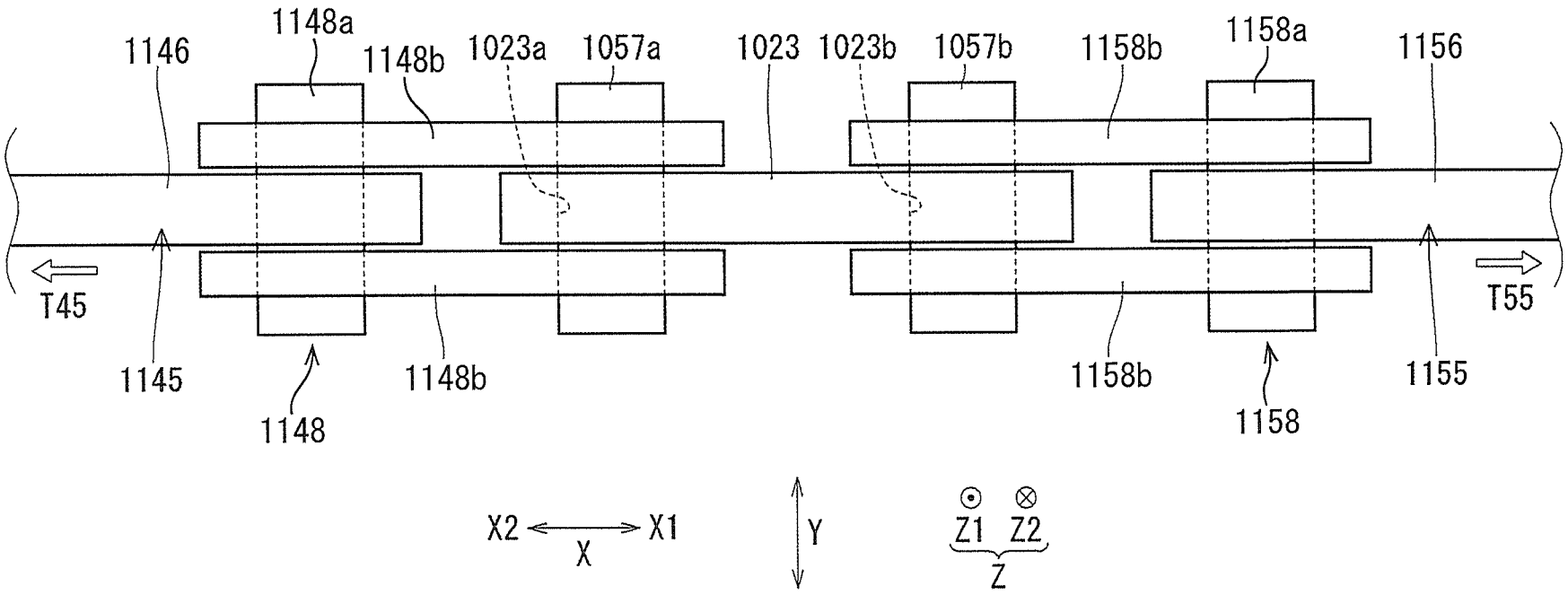
FIG. 18 is a plan view showing a guy line connection structure according to Modification 11.
Figure 19:
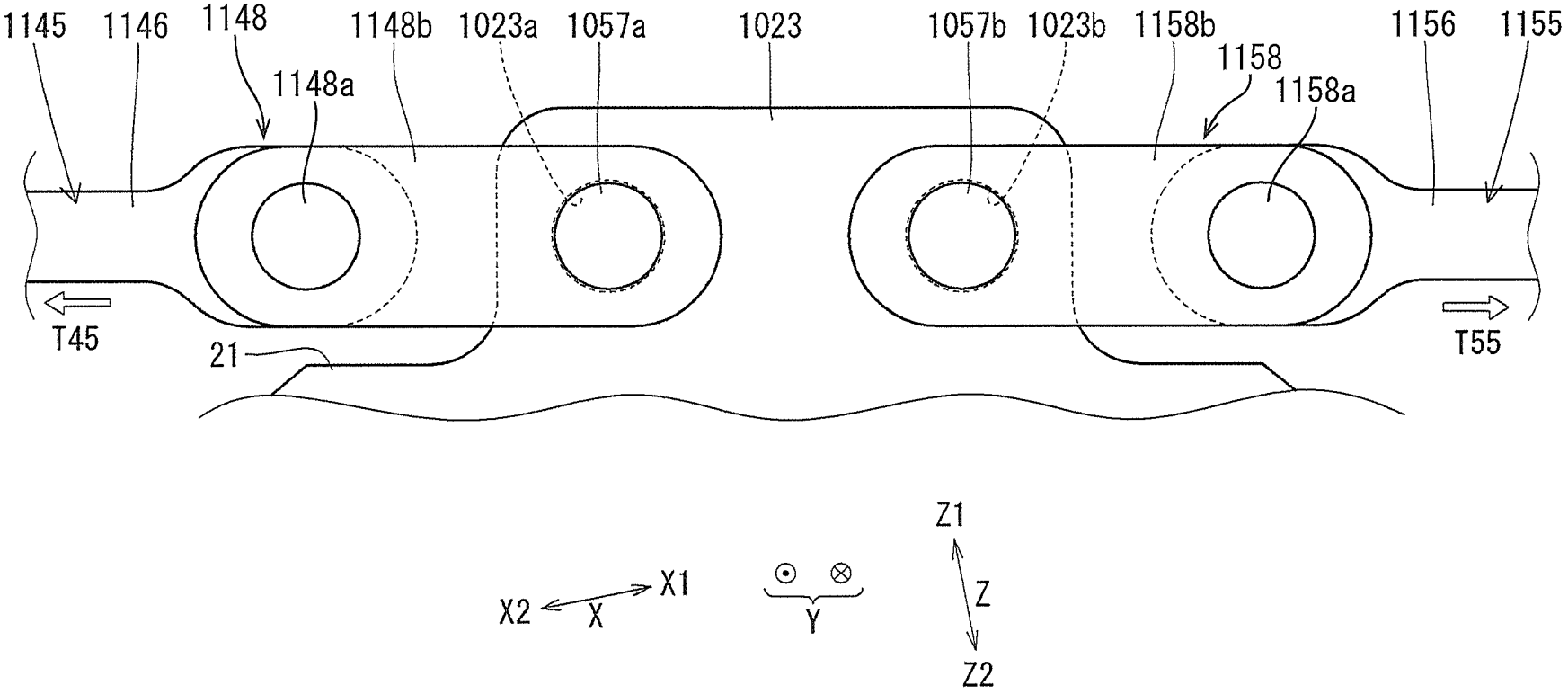
FIG. 19 is a side view showing a guy line connection structure according to Modification 11.

FIGS. 18 and 19 show a guy line connection structure according to Modification 11. While each of the boom guy line body 46 of the boom guy line 45 and the auxiliary sheave guy line body 56 of the auxiliary sheave guy line 55 that are shown in FIGS. 16 and 17 is formed of a guy cable, FIGS. 18 and 19 show a boom guy line 1145 and an auxiliary sheave guy line 1155 that include a boom guy line body 1146 and an auxiliary sheave guy line body 1156, respectively, each of the boom guy line 1145 and the auxiliary sheave guy line 1155 being formed of a guy link.

The boom guy line body 1146 has a distal-end-side end portion joined with a first boom connection portion 1148 and the auxiliary sheave guy line body 1156 has a proximal-end-side end portion joined with a second boom connection portion 1158, the first and second boom connection portions 1148, 1158 being connectable to a common guy line connection portion 1023. The first boom connection portion 1148 includes a connection pin 1148*a* and a pair of pin insertion portions 1148*b*. The pair of pin insertion portions

1148*b* have respective proximal end portions disposed on both sides of the distal end portion of the boom guy line body 1146 in the boom width direction Y, and respective distal end portions opposite to the proximal end portions. The connection pin 1148*a* penetrates the distal end portion of the boom guy line body 1146 and the proximal end portions of the pair of pin insertion portions 1148*b* in the boom width direction Y, thereby interconnecting these portions. The second boom connection portion 1158 includes a connection pin 1158*a* and a pair of pin insertion portions 1158*b*. The pair of pin insertion portions 1158*b* have respective proximal end portions arranged on both sides of the proximal end portion of the auxiliary sheave guy line body 1156 in the boom width direction Y and respective distal end portions opposite to the proximal end portions. The connection pin 1158*a* penetrates the proximal end portion of the auxiliary sheave guy line body 1156 and the proximal end portions of the pair of pin insertion portions 1158*b* in the boom width direction Y, thereby interconnecting these portions.

The distal end portions of the pair of pin insertion portions 1148*b* are disposed on both sides of the guy line connection portion 1023 in the boom width direction Y, wherein a first connection pin 1057*a* is inserted through a first connection pin hole 1023*a* formed in the guy line connection portion 1023 and respective pin holes formed in the pair of pin insertion portions 1148*b*, thereby connecting the first boom connection portion 1148 to the guy line connection portion 1023. Similarly, the distal end portions of the pair of pin insertion portions 1158*b* are disposed on both sides of the guy line connection portion 1023 in the boom width direction Y, wherein a second connection pin 1057*b* is inserted through a second connection pin hole 1023*b* formed in the guy line connection portion 1023 and respective pin holes formed in the pair of pin insertion portions 1158*b*, thereby connecting the second boom connection portion 1158 to the guy line connection portion 1023.

Other than the above Modification 11, the present invention also encompasses a mode where one of the boom guy line body and the auxiliary sheave guy line body is formed of a guy cable and the other is formed of a plurality of guy links.

Figure 20:
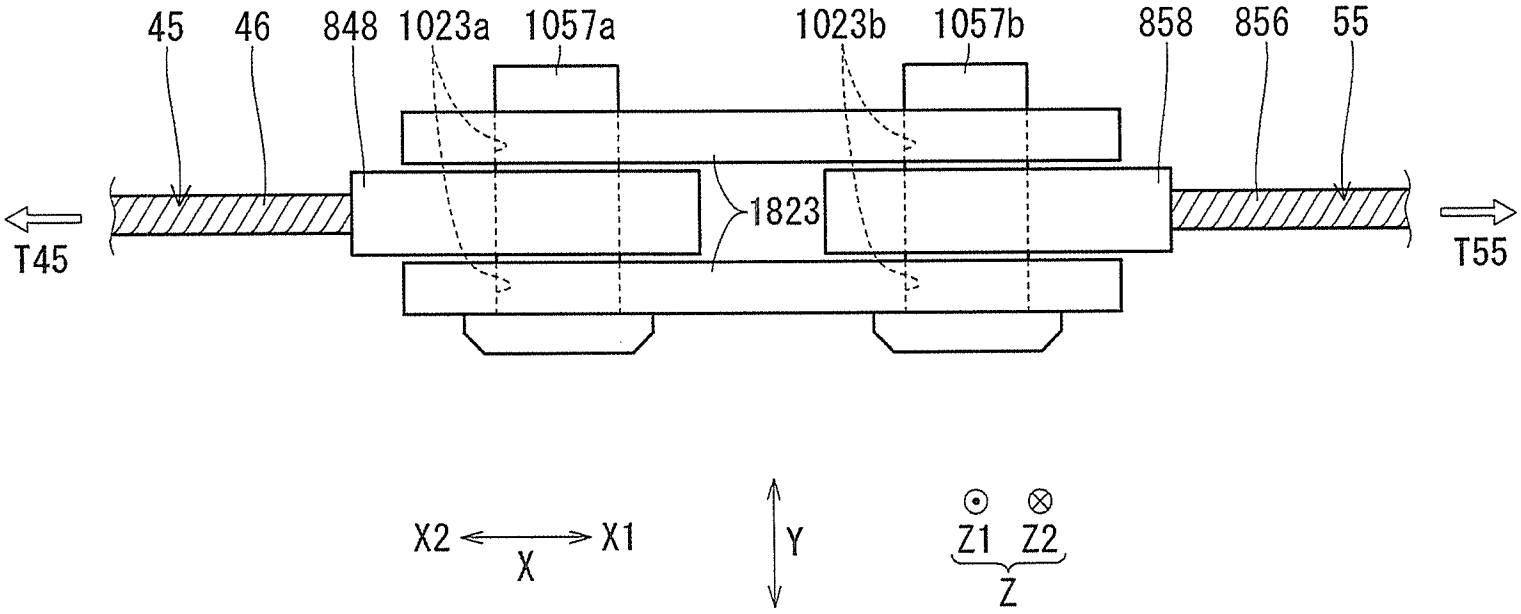
FIG. 20 is a plan view showing a guy line connection structure according to Modification 12.

FIG. 20 shows a guy line connection structure according to Modification 12. While the first connection portion 48 and the second boom connection portion 58 in the structure shown in FIG. 16 have the pair of pin insertion portions 48*b* and the pair of pin insertion portions 58, respectively, and these pin insertion portions are disposed on both sides of the guy line connection portion 1023 formed of a single plate-like member in the boom width direction Y, FIG. 20 shows a structure where a first boom connection portion 848 and a second boom connection portion 858 each formed of a single plate-like member are disposed between a pair of guy line connection portions 1823 arranged right and left. The first and second boom connection portions 848, 858 are spaced in the boom axis direction X and connectable to the pair of guy line connection portions 1823 through a first connection pin 1057*a* and a second connection pin 1057*b*, respectively, the first and second connection pins 1057*a*, 1057*b* being independent of each other. Also respective members constituting the pair of guy line connection portions 1823 serve as the common guy line connection member that includes both of a first guy line connection portion connected to the first boom connection portion 848 and a second guy line connection portion connected to the second boom connection portion 858.

Figure 21:
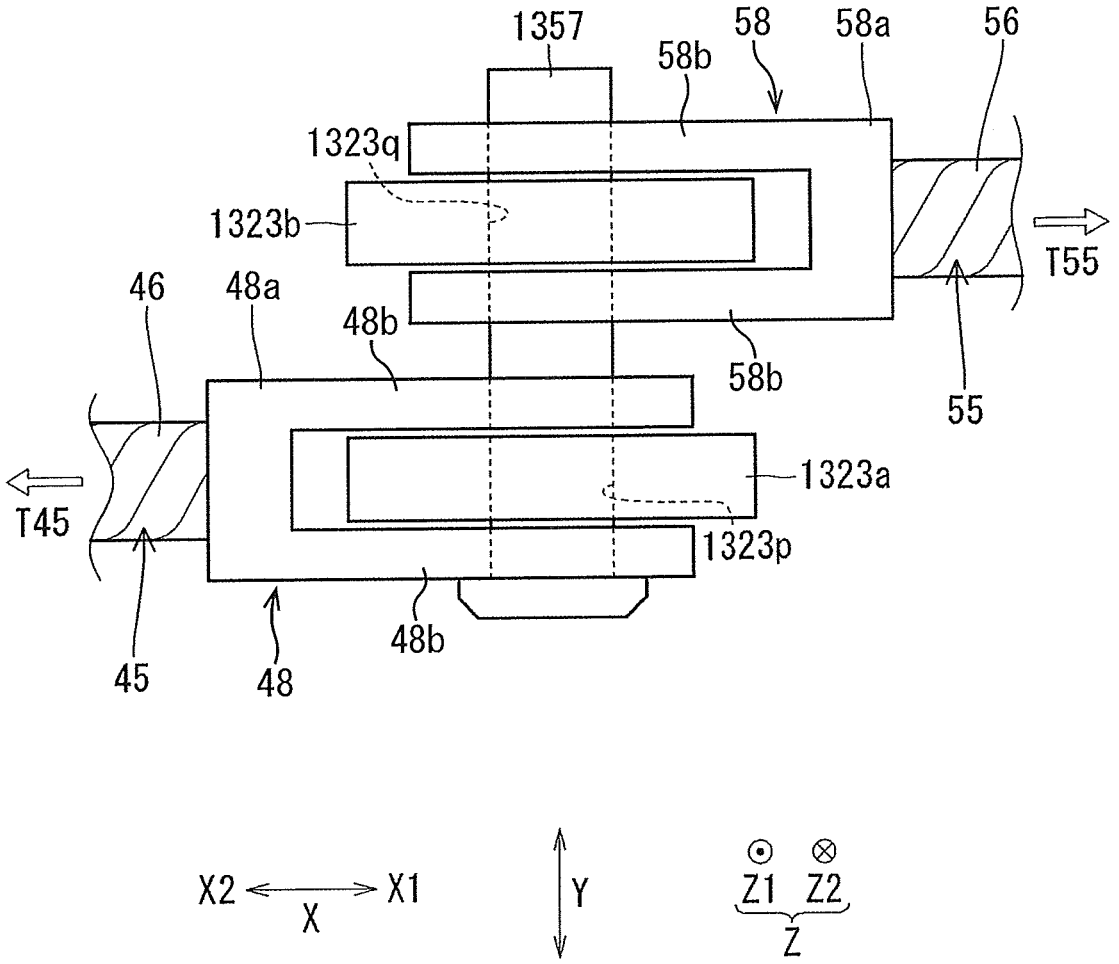
FIG. 21 is a plan view showing a guy line connection structure according to Modification 13.

FIG. 21 shows a guy line connection structure according to Modification 13. While the first and second boom connection portions 48, 58 of the boom guy line 45 and the auxiliary sheave guy line 55 in the structure shown in FIGS. 4 and 5 are connectable to the common guy line connection portion 23, the structure shown in FIG. 21 includes a first guy line connection portion 1323*a* and a second guy line connection portion 1323*b* that are formed of independent members of each other and arranged right and left (i.e. spaced in the boom width direction Y), in place of the guy line connection portion 23 formed of the common guy line connection member, and the first boom connection portion 48 of the boom guy line 45 is connected to the first guy line connection portion 1323*a* and the second boom connection portion 58 of the auxiliary sheave guy line 55 is connected to the second guy line connection portion 1323*b*. The first and second guy line connection portions 1323*a*, 1323*b* are disposed on the back surface portion 20*tb* of the boom distal end portion 20*t* shown in FIG. 2. The first and second guy line connection portions 1323*a*, 1323*b* are formed with first and second connection pin holes 1323*p*, 1323*q*, respectively, and the first and second guy line connection portions 1323*a*, 1323*b* are disposed so as to render the first and second connection pin holes 1323*p*, 1323*q* coaxial with each other. The structure shown in FIG. 21 includes a single and long guy line connection pin 1357, which is inserted through all of respective pin holes formed in the pair of pin insertion portions 48*b* of the first boom connection portion 48, the first connection pin hole 1323*p*, the respective pin holes formed in the pair of pin insertion portions 58*b* of the second boom connection portion 58, and the second connection pin hole 1323*q* to thereby establish both of connection of the first boom connection portion 48 to the first guy line connection portion 1323*a* and connection of the second boom connection portion 58 to the second guy line connection portion 1323*b*. This structure enables a load acting on the guy line connection pin 1357 in the boom axis direction X from the first boom connection portion 48 due to the tension T45 of the boom guy line body 46 of the boom guy line 45 and a load acting on the guy line connection pin 1357 in the boom axis direction X from the second boom connection portion 58 due to the tension T55 of the auxiliary sheave guy line body 56 of the auxiliary sheave guy line 55 to cancel each other.

The direction in which the first and second guy line connection portions 1323*a*, 1323*b* are arranged is not limited to the boom width direction Y. For example, the first and second guy line connection portions 1323*a*, 1323*b* may be either spaced in the boom axis direction X as shown in FIGS. 23 and 24 or spaced in both of the boom axis direction X and the boom width direction Y.

Figure 22:
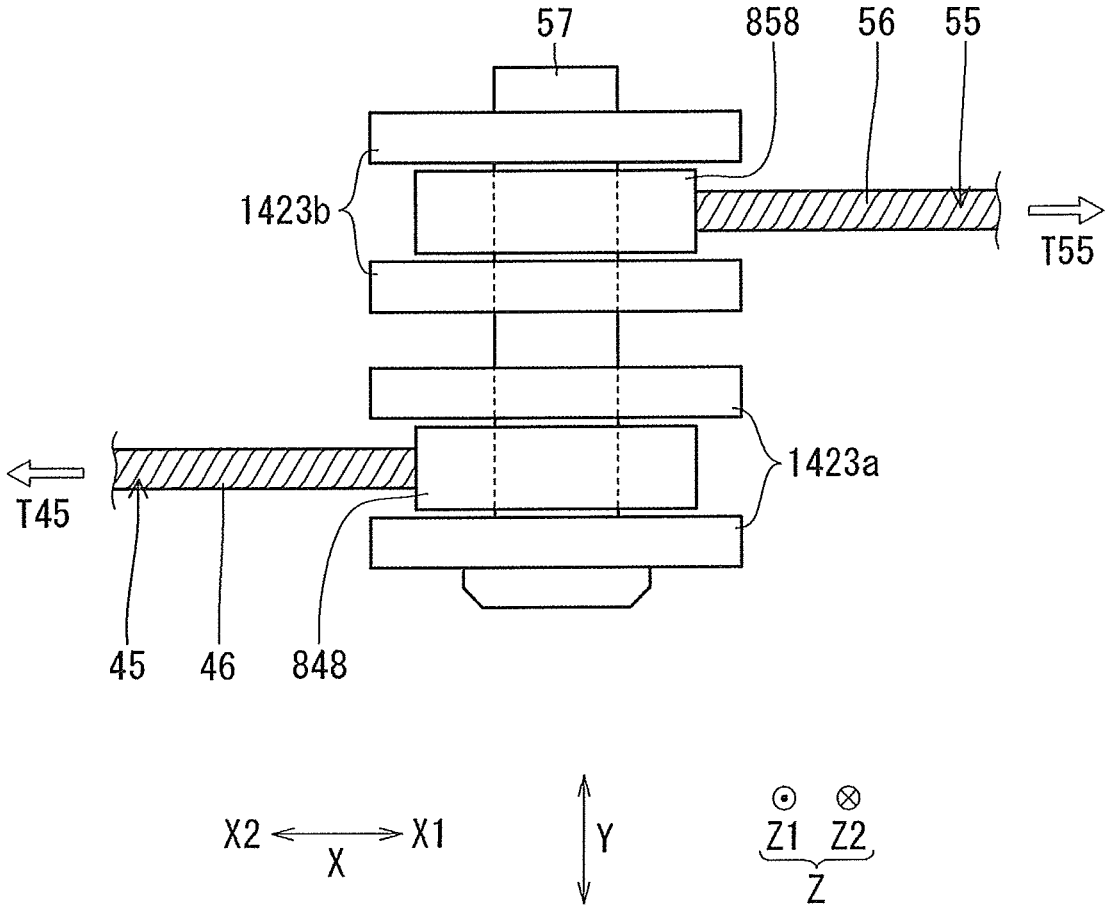
FIG. 22 is a plan view showing a guy line connection structure according to modification 14.

FIG. 22 shows a guy line connection structure according to Modification 14. While the first and second boom connection portions 48, 58 shown in the structure shown in FIG. 21 have the pair of pin insertion portions 48*b* and the pair of pin insertion portions 58*b*, respectively, and each of the first and second guy line connection portions 1323*a*, 1323*b* is formed of a single plate-like member, the structure shown in FIG. 22 includes a first guy line connection portion 1423*a* and a second guy line connection portion 1423*b* each formed of a pair of plate-like members arranged right and left, between which members a first boom connection portion 848 and a second boom connection portion 858 each formed of a single plate-like member are disposed.

Figure 23:
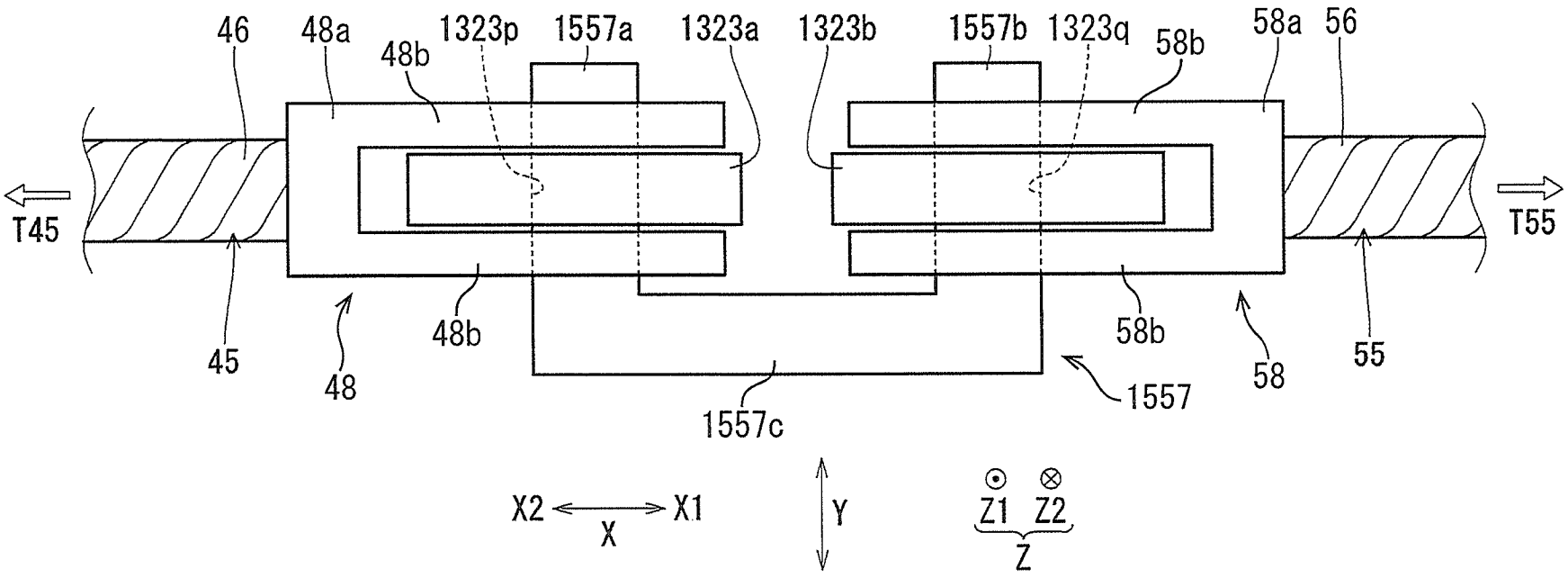
FIG. 23 is a plan view showing a guy line connection structure according to modification 15.
Figure 24:
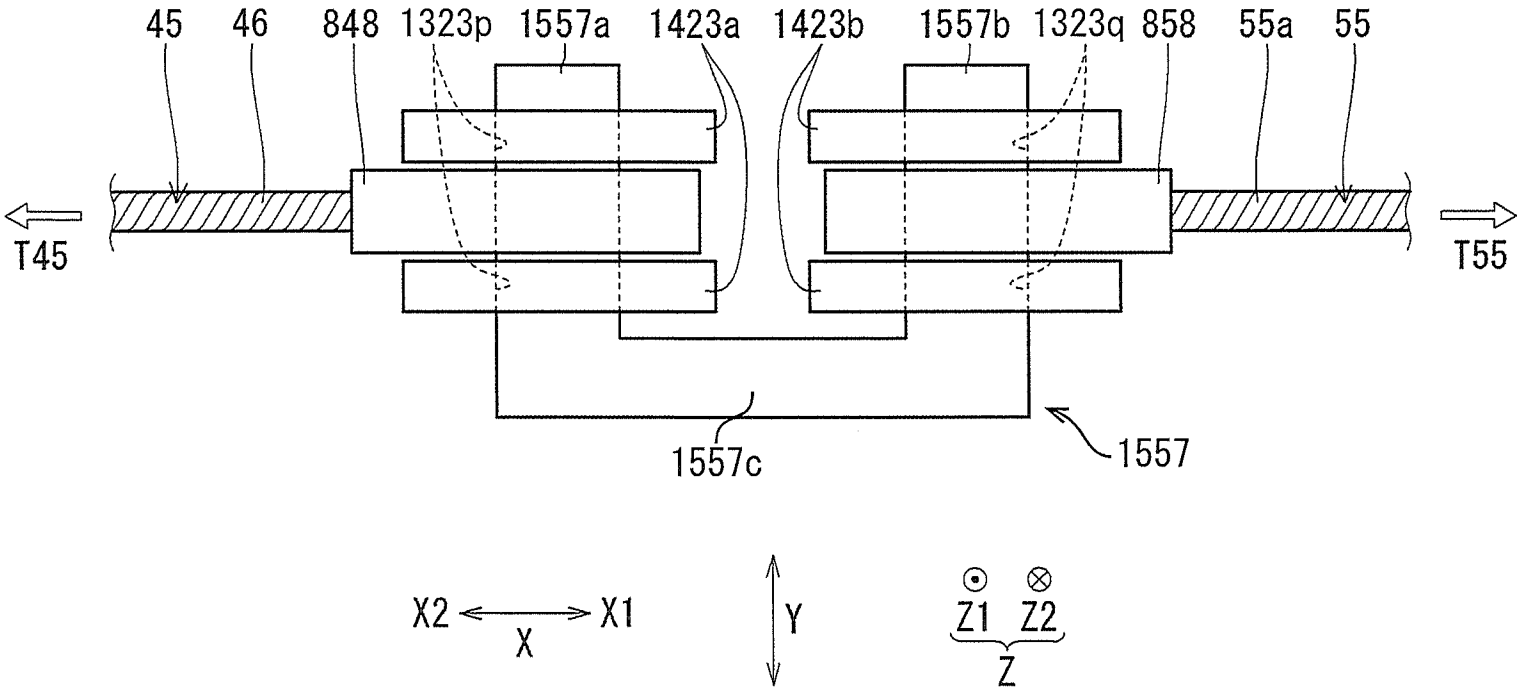
FIG. 24 is a plan view showing a guy line connection structure according to Modification 16.

FIG. 23 shows a guy line connection structure according to Modification 15. While the first and second guy line connection portions 1323*a*, 1323*b* in the structure shown in FIG. 21 are arranged right and left in the boom width direction Y, the structure shown in FIG. 23 includes first and second guy line connection portions 1323*a*, 1323*b* that are arranged right and left in the boom axis direction X. Besides, while the structure shown in FIG. 16 includes the first and second connection pins 1057*a*, 1057*b* independent of each other, the structure shown in FIG. 23 includes a guy line connection member 1557 formed of a single member. The guy line connection member 1557 includes a first connection pin portion 1557*a*, a second connection pin portion 1557*b*, and a pin coupling portion 1557*c* coupling the first and second connection pin portions 1557*a*, 1557*b* to each other and being integral with the first and second connection pin portions 1557*a*, 1557*b*. The first connection pin portion 1557*a* is inserted through a first connection pin hole 1323*p* formed in the first guy line connection portion 1323*a* and respective pin holes formed in the pair of pin insertion portions 48*b* of the first boom connection portion 48 to thereby connect the first guy line connection portion 1323*a* to the first boom connection portion 48. The second connection pin portion 1557*b* is inserted through a second connection pin hole 1323*q* formed in the second guy line connection portion 1323*b* and respective pin holes formed in the pair of pin insertion portions 58*b* of the second boom connection portion 58 to thereby connect the second guy line connection portion 1323*b* to the second boom connection portion 58. The pin coupling portion 1557*c* is integrally joined with respective ends of the first and second connection pin portions 1557*a*, 1557*b*, the respective ends being one of the opposite ends of the first and second connection pin portions 1557*a*, 1557*b* and directed to the same side in the boom width direction Y.

This structure enables a load acting on the guy line connection member 1557 in the boom axis direction X from the first boom connection portion 48 due to the tension T45 of the boom guy line body 46 of the boom guy line 45 including the first boom connection portion 48 and a load acting on the guy line connection member 1557 in the boom axis direction X from the second boom connection portion 58 due to the tension T55 of the auxiliary sheave guy line body 56 of the auxiliary sheave guy line 55 including the second boom connection portion 58 to cancel each other.

FIG. 24 shows a guy line connection structure according to Modification 16. While the first and second boom connection portions 48, 58 in the structure shown in FIG. 23 include the pair of pin insertion portions 48*b* and the pair of pin insertion portions 58*b*, respectively, the pair of pin insertion portions 48*b* being disposed on both sides of the first guy line connection portion 1323*a* formed of a single plate-like member, and the pair of pin insertion portions 58*b* being disposed on both sides of the second guy line connection portion 1323*b* formed of a single plate-like member, the structure shown in FIG. 24 includes a single guy line connection member 1557 similarly to the structure shown in FIG. 23, and further includes a first guy line connection portion 1423*a* and a second guy line connection portion 1423*b*. The first guy line connection portion 1423*a* is formed of a pair of plate-like members, between which a first boom connection portion 848 formed of a single plate-like member is disposed. The second guy line connection portion 1423*b* is formed of a pair of plate-like members, between which a second boom connection portion 858 formed of a single plate-like member is disposed.

Figure 25:
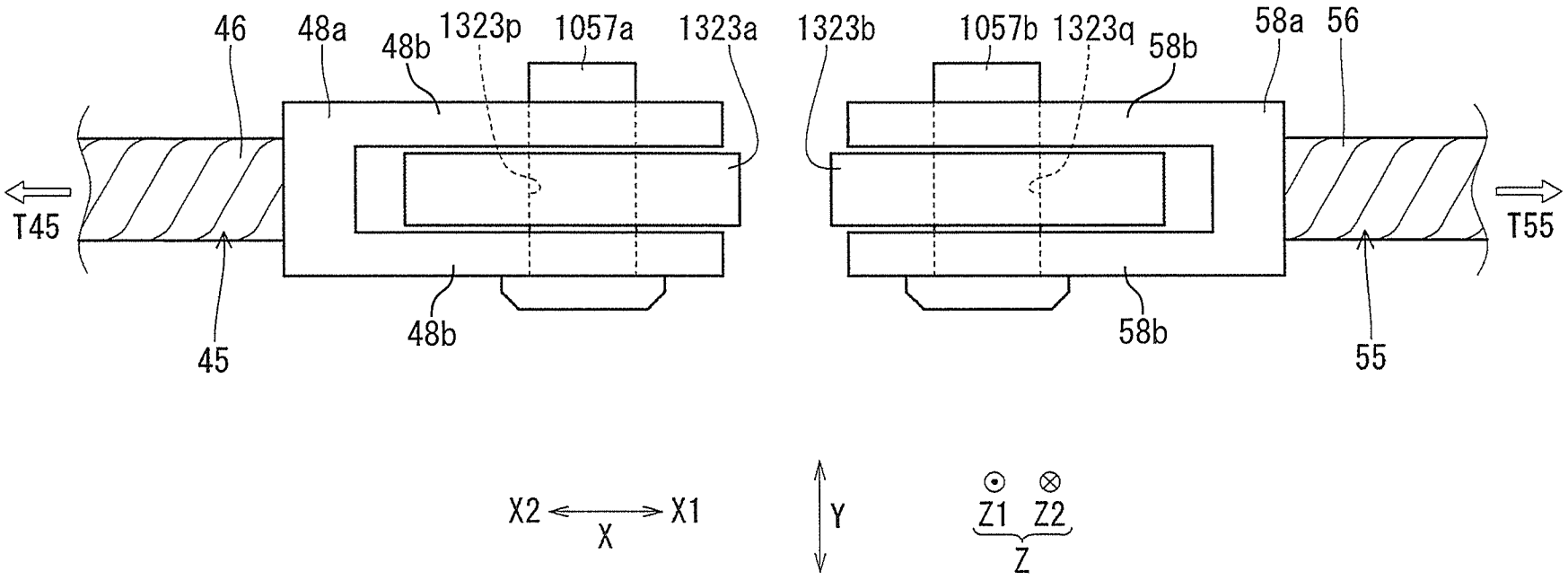
FIG. 25 is a plan view showing a guy line connection structure according to modification 17.

FIG. 25 shows a guy line connection structure according to Modification 17. This structure is modified from the structure shown in FIG. 23 by replacing the single guy line connection member 1557 with a first connection pin 1057*a* and a second connection pin 1057*b* that are independent of each other. This structure also enables a load acting on the back surface portion 20*tb* of the boom distal end portion 20*t* from the first boom connection portion 48 through the first guy line connection portion 1323*a* due to the tension T45 of the boom guy line body 46 of the boo guy line 45 and a load acting on the back surface portion 20*tb* from the second boom connection portion 58 through the second guy line connection portion 1323*b* due to the tension T55 of the auxiliary sheave guy line body 56 of the auxiliary sheave guy line 55 to cancel each other. The first and second connection pins 1057*a*, 1057*b* independent of each other can be also applied to first and second guy line connection portions 1323*a*, 1323*b* that are arranged not in the boom axis direction X, for example, as shown in FIG. 21.

Figure 26:
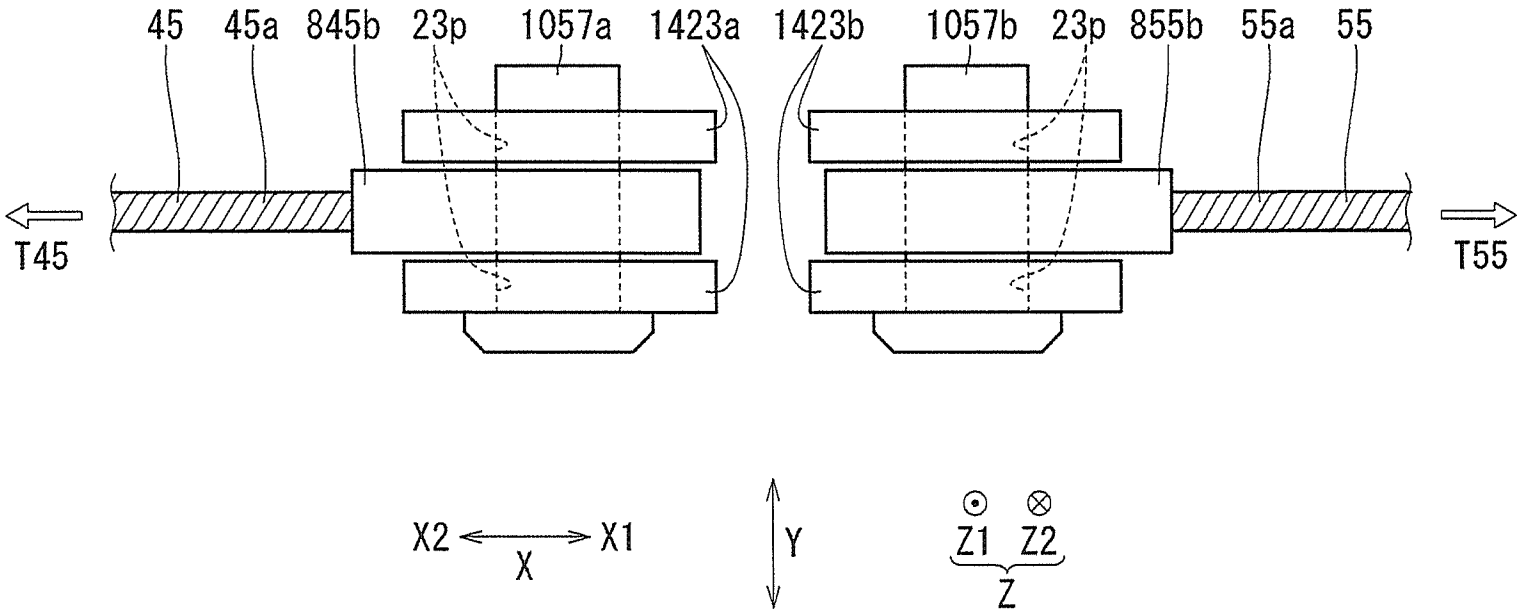
FIG. 26 is a plan view showing a guy line connection structure according to modification 18.

FIG. 26 shows a guy line connection structure according to Modification 18. This structure includes a first boom connection portion 845*b* and a second boom connection portion 855*b* each formed of a single plate-like member, in place of the first and second boom connection portions 48, 58 shown in FIG. 25, respectively. On the other hand, in place of the first and second guy line connection portion 1323*a*, 1323*b* shown in FIG. 25, the structure shown FIG. 26 includes a first guy line connection portion 1423*a* and a second guy line connection portion 1323*b* each formed of a pair of plate-like members arranged right and left, between which the first and second boom connection portions are disposed, respectively.

(Other Modifications)

The above-described embodiment can be variously modified in ways different from the above Modifications 1 to 18. For example, constituent elements included in the embodiment or modifications different from each other may be combined. For example, each constituent element may be modified in arrangement and/or shape. For example, constituent elements may be modified in number or part of constituent elements may be omitted. For example, fixation or connection of constituent elements may be either direct or indirect. For example, constituent elements that have been described as a plurality of members or portions different from each other may be configured as a single member or portion. For example, a constituent element that has been described as a single member or portion may be provided formed of a plurality of members or portions different from each other.

For example, there may be a crane that includes the boom derricking device 40 including the gantry 41 shown in FIG. 1 while including the jib 770 shown in FIG. 13 as the derrick member, the jib 770 including a jib distal end portion 770*t* to which the auxiliary sheave device according to the present invention is attached. Alternatively, there may be a crane that includes the boom derricking device 740 including the mast 741 but includes no jib, the auxiliary sheave device according to the present invention being directly attached to the boom distal end portion 20*t* of the boom 20 shown in FIG. 2.

The number of guy lines according to the present invention is not limited. For example, the pair of boom guy lines 45 according to the above-described embodiment may be replaced with a single boom guy line or three or more boom guy lines, and the pair of auxiliary sheave guy lines 55 may be replaced with a single sheave guy line. According to the number of boom guy lines and the number of auxiliary sheave guy lines connected thereto can be appropriately modified the specific structure of the guy line connection portion.

As described above, there is provided an auxiliary sheave device capable of having a simple and lightweight structure. Provided is an auxiliary sheave device provided in a crane including a derrick member capable of being derricked with a vertically rotational movement thereof and a derrick member guy line connected to a distal end portion of the derrick member in order to derrick the derrick member, the auxiliary sheave device comprising: an auxiliary sheave frame attached to the distal end portion of the derrick member so as to be capable of making vertically rotational movement and taking a projecting posture of projecting beyond the distal end portion of the derrick member in a derrick-member distal-end direction that is a direction from a proximal end of the derrick member toward the distal end portion thereof, an auxiliary sheave guy line connected to a distal side portion of the auxiliary sheave frame and to the derrick member to thereby keep the auxiliary sheave frame in the projecting posture, and an auxiliary sheave rotatably attached to the distal end portion of the auxiliary sheave frame and allowing an auxiliary hoisting rope to be applied to the auxiliary sheave.

The auxiliary sheave device is allowed to have a simpler and lighter structure in comparison with, for example, a case where the auxiliary sheave frame is directly fixed to a boom distal end portion as disclosed in Patent Literature 1. Besides, the connection of the auxiliary sheave guy line to the distal-side portion of the auxiliary sheave frame (that is, a portion on the distal side of the longitudinally middle portion of the auxiliary sheave frame) enables the moment of the force by which the auxiliary shave guy line supports the auxiliary frame to be greater than that in a case of connection of the auxiliary sheave guy line to a proximal-side portion of the auxiliary sheave frame. This makes it possible to reduce the strength required for the auxiliary sheave frame to thereby allow the auxiliary sheave to have simple and lightweight structure, that is, to allow the auxiliary sheave device to have simple and lightweight structure. The thus slimmed auxiliary sheave device contributes to improved lifting capacity of the derrick member and the auxiliary sheave device for lifting a suspended load.

Preferably, the auxiliary sheave device further comprises a first guy line connection portion joined with the derrick member and connectable with a first derrick member connection portion that is one of opposite end portions of the derrick member guy line and a closer one to the distal end portion of the derrick member and a second guy line connection portion joined with the derrick member and connectable with a second derrick member connection portion that is one of opposite end portions of the auxiliary sheave guy line and a closer one to the proximal end portion of the derrick member.

More specifically, it is preferable that both of the first guy line connection portion and the second guy line connection portion are included in a common guy line connection member that is a member joined with the derrick member. The connections of both the derrick member guy line and the auxiliary sheave guy line to the common guy line connection member enables the derrick member guy line and the auxiliary sheave guy line to be continued with each other via the common guy line connection member. This arrangement renders a first load acting on the common guy line connection member from the boom guy line due to a tension of the boom guy line and a second load acting on the common guy line connection member from the auxiliary sheave guy line due to a tension of the auxiliary sheave guy line opposite or substantially opposite to each other to enable the first and second loads to cancel each other, thereby reducing the strength required for the derrick member including the common guy line connection member to allow the derrick member to have a simple and lightweight structure. The thus slimmed derrick member contributes to improved lifting capacity of the derrick member and the auxiliary sheave device for lifting a suspended load.

It is preferable that the crane further comprises at least one guy line connection pin that simultaneously connects the first derrick member connection portion of the derrick member guy line to the first guy line connection portion and connects the second derrick member connection portion of the auxiliary sheave guy line to the second guy line connection portion. The at least one guy line connection pin enables the two guy lines, namely, the derrick member guy line and the auxiliary sheave guy line, to be simultaneously connected to the first and second guy line connection portions, respectively, with a simple structure.

More specifically, it is preferable that the at least one guy line connection pin includes a common guy line connection pin configured to penetrate the first guy line connection portion, the second guy line connection portion, the first derrick member connection portion, and the second derrick member connection portion in a derrick member width direction parallel to an center axis of the rotational movement of the derrick member in a state where the first guy line connection portion, the second guy line connection portion, the first derrick member connection portion, and the second derrick member connection portion overlap each other in the derrick member width direction to thereby connect the first derrick member connection portion and the second derrick member connection portion to the first guy line connection portion and the second guy line connection portion, respectively. This enables the derrick member guy line and the auxiliary sheave guy line to be connected to the first and second guy line connection portions, respectively, with use of the common guy line connection pin, thereby allowing the guy line connection structure to be further simplified.

It is preferable that the auxiliary sheave guy line is flexible or bendable so as to allow the auxiliary sheave frame to make rotational movement relative to the derrick member in a direction from a ventral surface to a back surface of the derrick member. Such an auxiliary sheave guy line allows the auxiliary sheave frame of the auxiliary sheave device having been brought into contact with the ground involved by the falling of the derrick member to make rotational movement relative to the derrick member in an upward direction of the derrick member (in a direction coincident with the rising direction of the derrick member), even without the removal of the auxiliary sheave guy line from the derrick member; this restrains the load due to the mass of the derrick member from acting on the auxiliary sheave frame, thereby reducing the strength required for the auxiliary sheave device and the strength required for the distal end portion of the derrick member to support the auxiliary sheave device. This allows the auxiliary sheave device and the distal end portion of the derrick member to be simplified and slimmed. Besides, the auxiliary sheave frame having thus reduced required strength is allowed to project largely from the distal end portion of the derrick member in the derrick member distal end direction, which allows the distance from the distal end portion of the derrick member to the auxiliary sheave to be increased. This enables a main sheave, which is disposed, for example, at the distal end portion of the derrick member, to be apart from the main sheave at a large distance, thereby restraining the suspended load from the main sheave from coming into contact with a suspended load suspended from the auxiliary sheave.

Besides, the increase in the projection length of the auxiliary sheave device from the distal end portion of the derrick member in the derrick member distal end direction allows the lifting height of an auxiliary hook suspended from the auxiliary sheave to be increased.

Furthermore, the reduction in the strength required for the derrick member to support the auxiliary sheave device eliminates the necessity of a leg member (e.g. the boom support leg 27 shown in FIG. 2) for supporting the load of the derrick member or allows the leg member to be simplified.

The auxiliary sheave frame, for example, preferably includes a pair of supports attached to the distal end portion of the derrick member so as to be capable of rotational movement at respective positions spaced in a derrick member width direction parallel to a center axis of the rotational movement of the derrick member, and a distal end connection member interconnecting respective distal end portions of the pair of supports and supporting the auxiliary sheave rotatably. The distal end connection member is able to function as both a support connection member to interconnect the pair of supports and a sheave support member to support the auxiliary sheave, thereby enabling the structure of the auxiliary sheave device to be simplified.

In this mode, it is preferable that the distal end connection member has opposite end portions projecting outward beyond the pair of supports, respectively, in the derrick member width direction, each of the opposite end portions forming an auxiliary sheave guy line connection portion to be connected to the auxiliary sheave guy line. This enables the auxiliary sheave frame and the auxiliary sheave guy line to be interconnected with a simple structure with utilization of the opposite end portions of the distal end connection member.

Preferably, the auxiliary sheave device further comprises a strut disposed at a position closer to the distal end portion of the derrick member than a portion of the derrick member to which the auxiliary sheave guy line is connected, the strut projecting beyond the distal end portion of the derrick member in a direction from a ventral surface to a back surface of the derrick member, wherein the auxiliary sheave guy line includes a first guy line member connected to the strut and to a portion of the derrick member closer to the proximal end portion of the derrick member than the strut, and a second guy line member connected to the strut and to the distal side portion of the auxiliary sheave frame.

The strut enables a middle portion of the auxiliary sheave guy line between the first and second guy line members to be located at a position away from the back surface of the derrick member upward of the derrick member (in the direction from the ventral surface to the back surface) in comparison with the case of no strut with the auxiliary sheave guy line formed of a single member. This allows the angle of the auxiliary sheave guy line to a longitudinal direction of the auxiliary sheave frame to be large to reduce the tension acting on the auxiliary sheave guy line and to suppress the compressive force acting on the auxiliary sheave frame due to the tension. These contribute to improved lifting capacity of the auxiliary sheave device.

It is preferable that the auxiliary sheave device further includes a backstop interposed between the derrick member and the auxiliary sheave frame so as to restrain the auxiliary sheave frame from excessive making rotational movement relative to the derrick member beyond a predetermined angle in the same direction as a direction in which the derrick member rises. The backstop makes it possible to more reliably keep the auxiliary sheave frame in the projecting posture.

This application is based on Japanese Patent application No. 2019-157202 filed in Japan Patent Office on Aug. 29, 2019, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

Also provided is a crane comprising: a derrick member capable of being derricked with a vertically rotational movement thereof; a derrick member guy line connected to a distal end portion of the derrick member in order to derrick the derrick member; and the above-described auxiliary sheave device.

The invention claimed is:

1. An auxiliary sheave device provided in a crane including a derrick member capable of being derricked with a vertically rotational movement thereof and a derrick member guy line connected to a distal end portion of the derrick member in order to derrick the derrick member, the auxiliary sheave device comprising:

an auxiliary sheave frame attached to the distal end portion of the derrick member so as to be capable of making vertically rotational movement and taking a projecting posture of projecting beyond the distal end portion of the derrick member in a derrick-member distal-end direction that is a direction from a proximal end of the derrick member toward the distal end portion thereof;

an auxiliary sheave guy line connected to a distal side portion of the auxiliary sheave frame and to the derrick member to thereby keep the auxiliary sheave frame in the projecting posture;

an auxiliary sheave rotatably attached to the distal end portion of the auxiliary sheave frame and allowing an auxiliary hoisting rope to be applied to the auxiliary sheave;

a first guy line connection portion joined with the derrick member and connectable with a first derrick member connection portion that is one of opposite end portions of the derrick member guy line and a closer one to the distal end portion of the derrick member and a second guy line connection portion joined with the derrick member and connectable with a second derrick member connection portion that is one of opposite end portions of the auxiliary sheave guy line and a closer one to the derrick member, wherein both of the first guy line connection portion and the second guy line connection portion are included in a common guy line connection member that is a member joined with the derrick member.

2. The auxiliary sheave device according to claim 1, wherein the auxiliary sheave guy line is flexible or bendable so as to allow the auxiliary sheave frame to make rotational movement relative to the derrick member in a direction from a ventral surface to a back surface of the derrick member.

3. The auxiliary sheave device according to claim 1, wherein the auxiliary sheave frame includes a pair of supports attached to the distal end portion of the derrick member so as to be capable of rotational movement at respective positions spaced in a derrick member width direction parallel to a center axis of the rotational movement of the derrick member, and a distal end connection member interconnecting respective distal end portions of the pair of supports and supporting the auxiliary sheave rotatably.

4. The auxiliary sheave device according to claim 3, wherein the distal end connection member has opposite end portions projecting outward beyond the pair of supports, respectively, in the derrick member width direction, each of the opposite end portions forming an auxiliary sheave guy line connection portion to be connected to the auxiliary sheave guy line.

5. The auxiliary sheave device according to claim 1, further comprising a strut disposed at a position closer to the distal end portion of the derrick member than a portion of the derrick member to which the auxiliary sheave guy line is connected, the strut projecting beyond the distal end portion of the derrick member in a direction from a ventral surface to a back surface of the derrick member, wherein the auxiliary sheave guy line includes a first guy line member connected to the strut and to a portion of the derrick member closer to the proximal end portion of the derrick member than the strut, and a second guy line member connected to the strut and to the distal side portion of the auxiliary sheave frame.

6. The auxiliary sheave device according to claim 1, wherein the auxiliary sheave device further includes a backstop interposed between the derrick member and the auxiliary sheave frame so as to restrain the auxiliary sheave frame from excessive making rotational movement relative to the derrick member beyond a predetermined angle in the same direction as a direction in which the derrick member rises.

7. A crane comprising:

a derrick member capable of being derricked with a vertically rotational movement thereof;

a derrick member guy line connected to a distal end portion of the derrick member in order to derrick the derrick member; and the auxiliary sheave device according to claim 1.

8. An auxiliary sheave device provided in a crane including a derrick member capable of being derricked with a vertically rotational movement thereof and a derrick member guy line connected to a distal end portion of the derrick member in order to derrick the derrick member, the auxiliary sheave device comprising:

an auxiliary sheave frame attached to the distal end portion of the derrick member so as to be capable of making vertically rotational movement and taking a projecting posture of projecting beyond the distal end portion of the derrick member in a derrick-member distal-end direction that is a direction from a proximal end of the derrick member toward the distal end portion thereof;

an auxiliary sheave guy line connected to a distal side portion of the auxiliary sheave frame and to the derrick member to thereby keep the auxiliary sheave frame in the projecting posture;

an auxiliary sheave rotatably attached to the distal end portion of the auxiliary sheave frame and allowing an auxiliary hoisting rope to be applied to the auxiliary sheave; and a first guy line connection portion joined with the derrick member and connectable with a first derrick member connection portion that is one of opposite end portions of the derrick member guy line and a closer one to the distal end portion of the derrick member and a second guy line connection portion joined with the derrick member and connectable with a second derrick member connection portion that is one of opposite end portions of the auxiliary sheave guy line and a closer one to the derrick member; and at least one guy line connection pin that simultaneously connects the first derrick member connection portion of the derrick member guy line to the first guy line connection portion and connects the second derrick member connection portion of the auxiliary sheave guy line to the second guy line connection portion.

9. The auxiliary sheave device according to claim 8, wherein the at least one guy line connection pin includes a common guy line connection pin configured to penetrate the first guy line connection portion, the second guy line connection portion, the first derrick member connection portion, and the second derrick member connection portion in a derrick member width direction parallel to an center axis of the rotational movement of the derrick member in a state where the first guy line connection portion, the second guy line connection portion, the first derrick member connection portion, and the second derrick member connection portion overlap each other in the derrick member width direction to thereby connect the first derrick member connection portion and the second derrick member connection portion to the first guy line connection portion and the second guy line connection portion, respectively.

10. The auxiliary sheave device according to claim 8, wherein the auxiliary sheave guy line is flexible or bendable so as to allow the auxiliary sheave frame to make rotational movement relative to the derrick member in a direction from a ventral surface to a back surface of the derrick member.

11. The auxiliary sheave device according to claim 8, wherein the auxiliary sheave frame includes a pair of supports attached to the distal end portion of the derrick member so as to be capable of rotational movement at respective positions spaced in a derrick member width direction parallel to a center axis of the rotational movement of the derrick member, and a distal end connection member interconnecting respective distal end portions of the pair of supports and supporting the auxiliary sheave rotatably.

12. The auxiliary sheave device according to claim 11, wherein the distal end connection member has opposite end portions projecting outward beyond the pair of supports, respectively, in the derrick member width direction, each of the opposite end portions forming an auxiliary sheave guy line connection portion to be connected to the auxiliary sheave guy line.

13. The auxiliary sheave device according to claim 8, further comprising a strut disposed at a position closer to the distal end portion of the derrick member than a portion of the derrick member to which the auxiliary sheave guy line is connected, the strut projecting beyond the distal end portion of the derrick member in a direction from a ventral surface to a back surface of the derrick member, wherein the auxiliary sheave guy line includes a first guy line member connected to the strut and to a portion of the derrick member closer to the proximal end portion of the derrick member than the strut, and a second guy line member connected to the strut and to the distal side portion of the auxiliary sheave frame.

14. The auxiliary sheave device according to claim 8, wherein the auxiliary sheave device further includes a backstop interposed between the derrick member and the auxiliary sheave frame so as to restrain the auxiliary sheave frame from excessive making rotational movement relative to the derrick member beyond a predetermined angle in the same direction as a direction in which the derrick member rises.

15. A crane comprising:

a derrick member capable of being derricked with a vertically rotational movement thereof;

a derrick member guy line connected to a distal end portion of the derrick member in order to derrick the derrick member; and the auxiliary sheave device according to claim 8.

* * * * *